US008297075B2

(12) United States Patent
Weitman

(10) Patent No.: US 8,297,075 B2
(45) Date of Patent: Oct. 30, 2012

(54) GEMSTONE CUT

(76) Inventor: Zev W. Weitman, Brooklyn, NY (US)

( * ) Notice: Subject to any disclaimer, the term of this patent is extended or adjusted under 35 U.S.C. 154(b) by 824 days.

(21) Appl. No.: 11/890,886

(22) Filed: Aug. 8, 2007

(65) Prior Publication Data

US 2008/0034793 A1 Feb. 14, 2008

Related U.S. Application Data

(60) Provisional application No. 60/836,263, filed on Aug. 8, 2006.

(51) Int. Cl.
*A44C 17/00* (2006.01)

(52) U.S. Cl. ..... 63/32; D11/90

(58) Field of Classification Search .. 63/32; D11/89–92
See application file for complete search history.

(56) References Cited

U.S. PATENT DOCUMENTS

| | | | | | |
|---|---|---|---|---|---|
| D475,650 | S | * | 6/2003 | Wueste | D11/90 |
| D478,528 | S | * | 8/2003 | Mehta et al. | D11/90 |
| 6,698,239 | B2 | * | 3/2004 | Wueste | 63/32 |
| D493,744 | S | * | 8/2004 | Jacobs | D11/90 |
| D504,081 | S | * | 4/2005 | Verelst | D11/90 |
| D514,472 | S | * | 2/2006 | Namdar | D11/90 |
| D516,457 | S | * | 3/2006 | Fuchs | D11/90 |
| D516,939 | S | * | 3/2006 | Hodara et al. | D11/90 |
| D524,186 | S | * | 7/2006 | Sato | D11/90 |
| D525,559 | S | * | 7/2006 | Aoyagi | D11/90 |
| D542,173 | S | * | 5/2007 | Hirapara et al. | D11/90 |
| D555,032 | S | * | 11/2007 | So | D11/90 |
| 2005/0000246 | A1 | * | 1/2005 | Brookshire | 63/32 |

* cited by examiner

*Primary Examiner* — Jack W. Lavinder
(74) *Attorney, Agent, or Firm* — Eckert Seamans Cherin & Mellott, LLC; William H. Dippert

(57) ABSTRACT

A gemstone cut into a round stone and method of cutting a gemstone are disclosed herein. A crown having a table may be surrounded by eight star sets. The eight star sets may be surrounded by eight bezel facets. The eight bezel facets may be surrounded by eight pairs of upper girdle facet sets. Each upper girdle facet set may have one primary upper girdle facet and two secondary upper girdle facets. Each star set may have one primary star facet and four secondary star facets. A bottom having a culet may be surrounded by 8 pavilions the eight pavilions may be surrounded by 8 lower girdle facet sets. Each lower girdle facet set may have one primary lower girdle facet and two secondary lower girdle facets. Both the crown and bottom may be surrounded by 16 girdle facets or by perfectly circular girdle.

10 Claims, 34 Drawing Sheets

GEMSTONE CUT

CROSS REFERENCE TO RELATED APPLICATIONS

This application claims priority to U.S. provisional Patent Application No. 60/836,263 filed Aug. 8, 2006 entitled "Gemstone", which is incorporated fully herein by reference.

FIELD OF THE INVENTION

The present invention relates to a gemstone, and more particularly, to the cut of a gemstone.

BACKGROUND OF THE INVENTION

A basic understanding of diamond cutting is provided to present a better understanding of the gemstone cut and method of cutting. Referring to FIG. 1, when drawing a sketch of a diamond on a flat piece of paper, the lines of the diamond are being drawn directly, and as a result, indirectly, there is the formation of "facets." The sketch has only two dimensions, and all of the lines and "facets" are in the same, one, geometrical plane (the flat piece of paper). When cutting a diamond the situation is reversed. The facets are being formed directly, and as a result, indirectly, there is the formation of lines. The actual diamond has three dimensions, and each facet is in its own separate geometrical plane.

A diamond in the rough has no facets, and hence, no lines. After the first facet is formed, there is also no line. The first line on the diamond can be (indirectly) formed when a second facet is "cut", and when the second facet intersects or meets the first facet. Where the second facet meets the first, a line is formed. The more degrees the second facet is "cut" away from the first facet, the more pronounced (or stronger) that line becomes. The fewer degrees the second facet is "cut" away from the first facet, the less pronounced (or weaker) the line becomes. In other words, the strength of the line between two facets i.e. how pronounced that line is can give approximate information as to how many degrees away from the first, the second facet lies.

Referring to FIG. 2, the position of the line between the two facets gives accurate information as to the direction from which facet B was cut on to facet A. There are four initial directions facet B can be cut from: Higher See FIG. 2*a* (facet B is cut on a higher angle than facet A), Flatter See FIG. 2*b* (facet B is cut on a flatter angle than facet A), Right See FIG. 2*c* and Left See FIG. 2*d*. From these four initial directions there are combinations of directions from which facet B can be cut from facet A: Higher and Right, Higher and Left, Flatter and Right, Flatter and Left. In four of these combinations facet B can be more degrees higher or flatter than right or left See FIGS. 2*e*-2*h*. In four of these combinations facet B can be more degrees right or left than higher or flatter See FIGS. 2*i*-2L. In four of these combinations facet B can be equally higher or flatter as from right or from left See FIGS. 2*m*-2*p*. A demonstration of these combinations is shown in FIG. 2 with illustrations of a rough diamond with facet A as the large circular facet, and facet B being cut on to facet A with the position of the tell tale line giving accurate information as to where facet B came from.

(An efficient and effective method for cutting a gemstone is needed for providing a brilliant reflective cut).

SUMMARY OF THE INVENTION

It is, therefore, an objective of the present invention to provide a cut gemstone and methods of cutting a gemstone.

An exemplary gemstone cut may be cut from a round stone. The gemstone may have a crown having a table surrounded by eight star sets. The eight star sets may be surrounded by eight bezel facets. The eight bezel facets may be surrounded by 8 pairs of upper girdle facet sets. Each upper girdle facet set may have one primary upper girdle facet and two secondary upper girdle facets. The two latter secondary upper girdle facets may be adjacent and parallel and lined up to each other and the girdle facet below them. Each star set may have one primary star set and four secondary star facets.

According to an exemplary embodiment of the present invention, the gemstone may incorporate the following embodiments. In one embodiment, one of the secondary upper girdle facets of each upper girdle facet set may be a narrow rectangular facet adjacent and parallel to a girdle facet of the gemstone, and lined up with that girdle facet. That narrow rectangular secondary upper girdle facet may also be adjacent and parallel to the triangular secondary upper girdle facet above it lining up with it. In this embodiment, two of the secondary star facets of each star set may be narrow rectangular facets adjacent and parallel to the table and to the triangular secondary star facets underneath them lining up with those triangular secondary star facets. In another embodiment each upper girdle facet set may have one of the secondary upper girdle facet, as one narrow rectangular facet adjacent and parallel and lining up to a girdle facet of the gemstone and may have an additional secondary upper girdle facet as a second narrow rectangular facet adjacent and parallel and lining up to the first narrow rectangular facet, all lining up with each other, and the triangular secondary upper girdle facet directly above them. In this embodiment, each star set may have two of the secondary star facets as two narrow rectangular facets adjacent and parallel to the table and each star set may have two additional secondary star facets as two second narrow rectangular facets adjacent and parallel to the first narrow rectangular facets. The narrow rectangular facets may line up with each other and the triangular secondary star facets directly underneath them. In addition, these above embodiments may have the bottom having 40 lower girdle facets. Another embodiment may have the bottom having 24 lower girdle facets See FIGS. 23*c* and 24*c*.

BRIEF DESCRIPTION OF THE DRAWINGS

The above and other objectives and advantages of the present invention will be apparent upon consideration of the following detailed description, taken in conjunction with the accompanying drawings, in which like reference numbers refer to like parts throughout, and in which.

DETAILED DESCRIPTION OF THE INVENTION

Figure 3A:
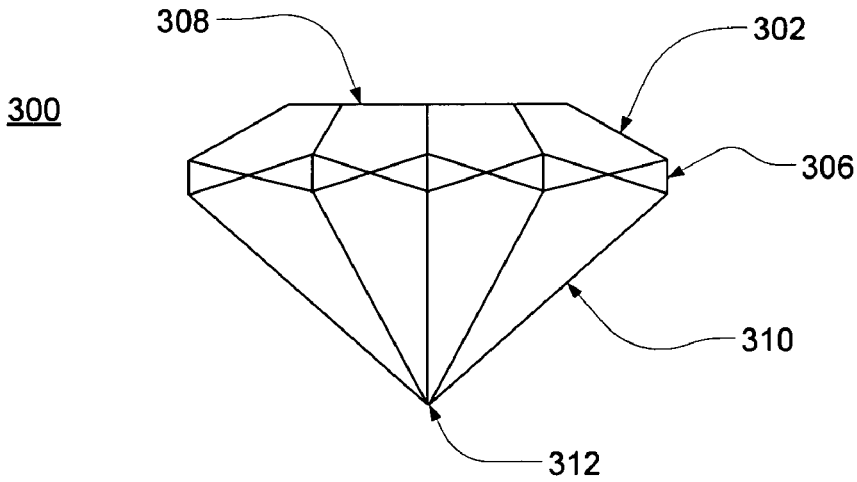
FIGS. 3A-3C show a blocked stone used as the foundation to cut the stone according to a first and second exemplary embodiment.
Figure 3B:
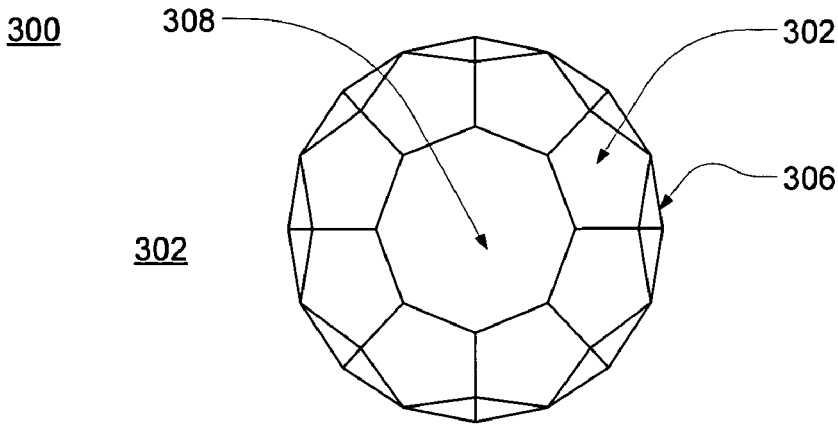
Figure 3C:
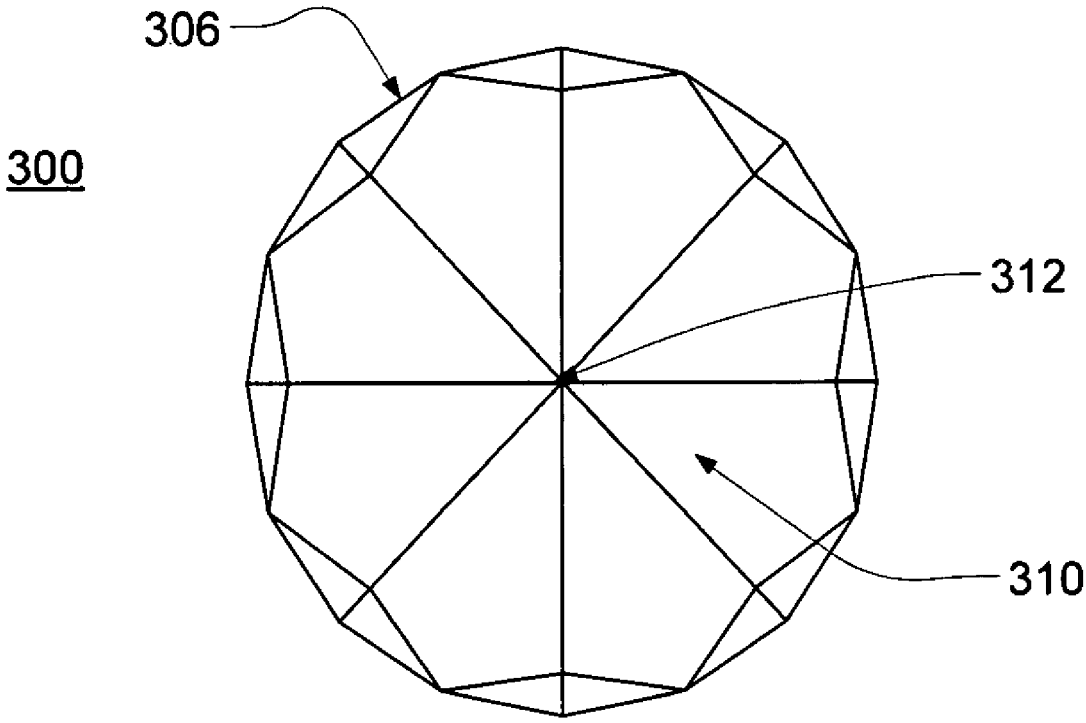

According to an exemplary embodiment, the stone is blocked like a round stone (BR) 300 as shown in FIG. 3A-3C. There are eight bezels 302 on a crown 304 between 30°-36° (to the Girdle 306), and a table 308. The table 308 may be about 58% (of the diameter) give or take a few percentage points. A total of nine blocking facets may be on the crown 304. There may be eight pavilions 310 on the bottom of the stone 40.5°-42.5° (to the Girdle 306). A culet 312 may be a point with no facet. There may be no culet or a very small culet. A total of eight, (or nine if culet is included), blocking facets may be on the bottom.

Figure 4A:
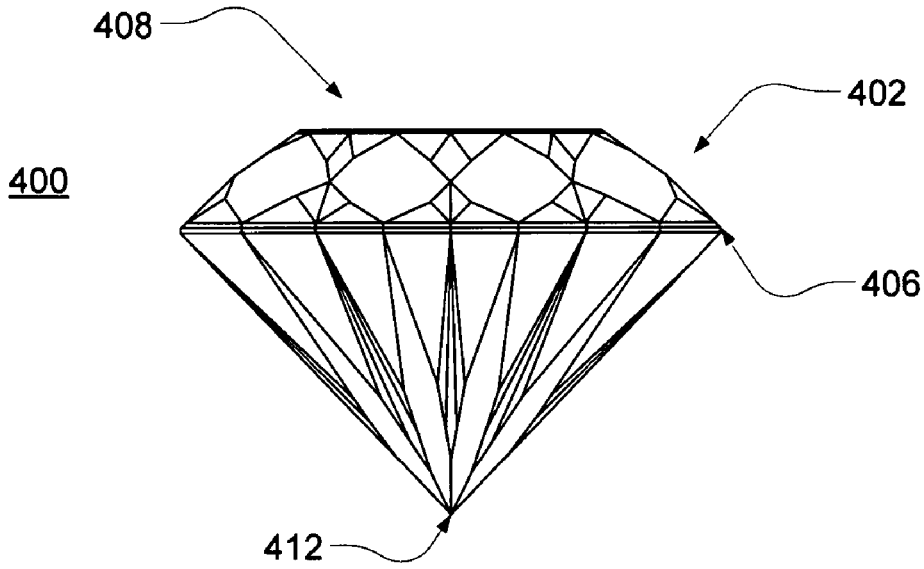
FIGS. 4A-4C show a full cut stone 400 according to an exemplary embodiment.
Figure 4B:
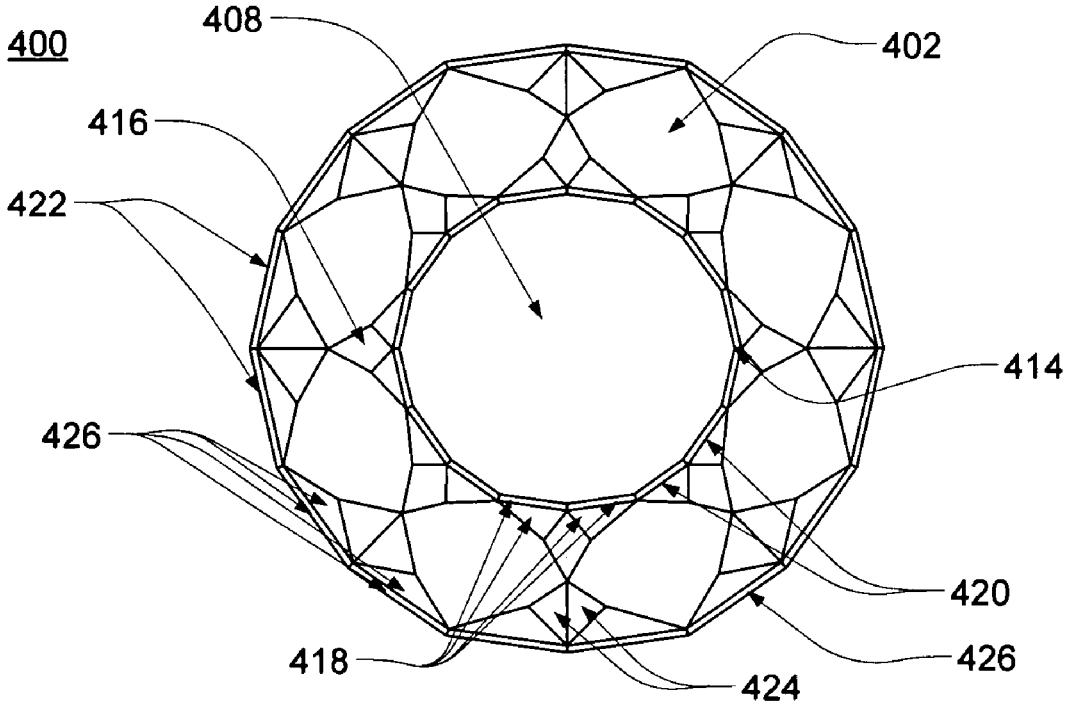
Figure 4C:
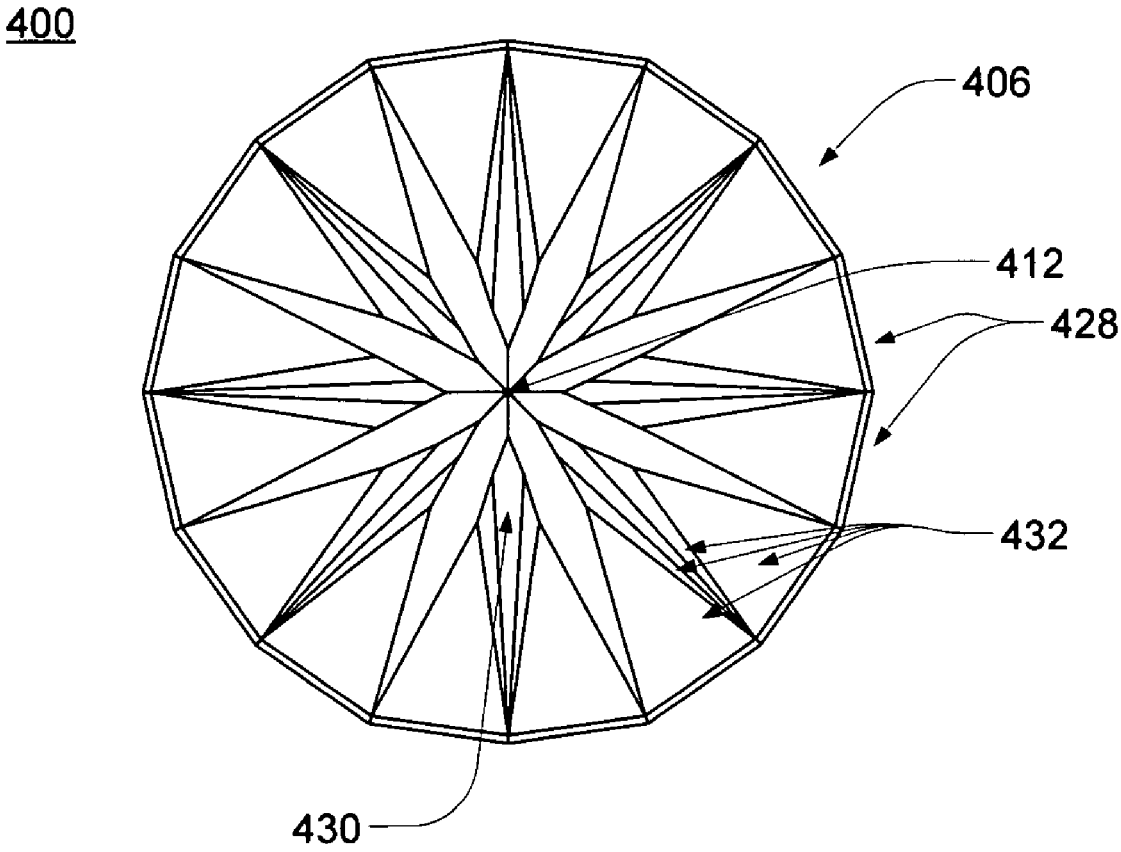

Referring to FIGS. 4A-4C, a full cut or (brilliandeered) stone 400 according to the exemplary embodiment may include eight star sets 414 (on a crown 404, off a table 408). Each star set 414 may have one primary facet 416 and four secondary facets 418. Two of the secondary facets may be narrow rectangular facets giving two lines off the table 408 instead of one in order to strengthen the reflection. According to a second exemplary embodiment, this double table line can be a triple table line by adding one more rectangular facet 420 under each of the two rectangular facets on each star set 414. As a result, each star set 414 would have six secondary star facets 418. A total of 40 star facets may be on the crown 404 according to the first exemplary embodiment. A total of 56 star facets may be on the crown 404 according to the second exemplary embodiment with triple table lines.

There may be eight pairs of upper girdle facet set 422, each one of the pair having one primary upper girdle facet 424 and each one of the pair having two secondary upper girdle facets 426. One of the secondary upper girdle facets 426 may be a narrow rectangular facet off the girdle adjacent and parallel and lining up with the girdle facet 406 directly below it. A total of 48 upper girdle facets are on the crown 404; totaling 88 brilliandeering facets on the crown and altogether 97 facets on the crown 404 according to the first exemplary embodiment. A total of 104 brilliandeering facets on the crown and altogether 113 facets may be on the crown 404 according to the second exemplary embodiment.

There may be eight sets of lower girdle facets 428 (on the bottom): each set may have one primary facet 430 and four secondary facets 432. A total of 40 lower girdle facets are on the bottom; totaling 48 facets on the bottom (49 if (very small) culet facet 412 is provided).

There may be sixteen narrow rectangular secondary upper girdle facets 426 above the girdle 406 located directly above the narrow rectangular girdle facets 406 adjacent and parallel and lined up with the girdle facets 406 according to the first exemplary embodiment. There may be additional narrow rectangular secondary upper girdle facets 426 that may be adjacent and parallel and lined up with the original narrow rectangular secondary upper girdle facets 426. A total of 161 facets may be on the stone 400 according to the double table line of the first exemplary embodiment. A total of 177 facets may be on the stone 400 according to the triple table line of the second exemplary embodiment. A total of 194 facets may be on the stone according the triple table line of $2^{nd}$ exemplary embodiment combined with triple girdle line of $2^{nd}$ exemplary embodiment. An additional facet may be provided if a culet facet 412 is provided.

Lines between facets (where one facet meets a second facet) are labeled rib lines; if one of those facets is the table 308, 408 the line is labeled a table line; if one of those facets is the girdle 306, 406 the line is labeled a girdle line. Stronger lines are labeled primary lines; weaker lines are labeled secondary lines. As a result of the added secondary brilliandeering facets, the form of the bezels and pavilions are slightly changed each with 4 additional primary rib lines. The form of the table may be changed from an octagon shaped facet to a 16 sided facet as a result of the added secondary star facets. The round stone 300 (BR) has 8 table lines; the stone 400, according to the exemplary embodiment may have sixteen primary table lines in symmetry with the sixteen girdle facets. This style of girdle faceting brilliandeering may be applied to any cut or shape (stone) when appropriate, as one skilled in the art would appreciate.

Figure 5A:
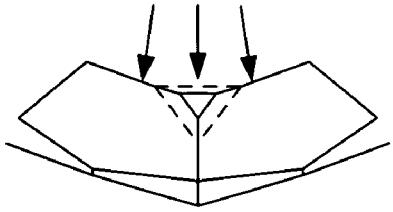
FIG. 5 illustrate the cuts for star facet sets of the exemplary method.

Referring to FIG. 5A, inception of primary star facet 416 is shown. See FIGS. 3A and 3B. The starting point of primary star facet 424 is cut directly between two bezels 302 approximately 10 degrees flatter than the bezels 302. Two points of primary star facet ("PSF") 416 reach about 80% to the center of the table lines and one point reaches about 60% to girdle 306 referring to FIG. 5B, the finished primary 424 star facet of FIG. 5A is shown. This primary star facet may be cut as a secondary bezel facet (see FIG. 16A) resulting in a second method of star and a pair of upper girdle facet sets. The starting point is where two table lines meet one rib line.

Figure 5B:
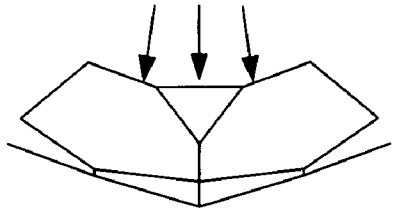
Figure 5C:
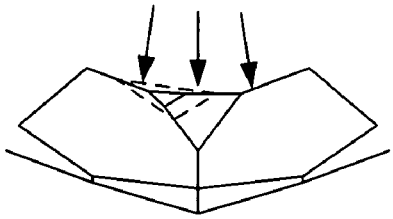
Figure 5D:
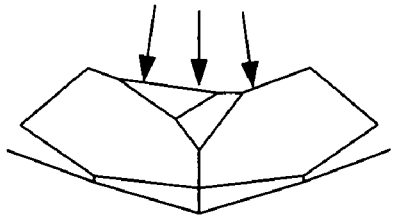

Referring to FIG. 5C, inception of this secondary star facet 418 may be on left point of PSF 416. The secondary star facet 418 is cut from flatter and left of PSF 416. The secondary star facet 418 may be cut as flat as practically possible so that the middle point drops toward girdle as minimum as possible. The left point reaches approximately 20% past center of bezel 302 indicated by arrow and right point reaches approximately 20% past center of primary star facet 416 indicated by arrow. Referring to FIG. 5D, the finished secondary star facet 418 of FIG. 5C is shown.

Figure 5E:
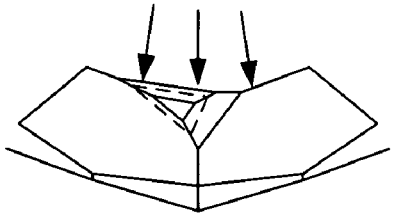
Figure 5F:
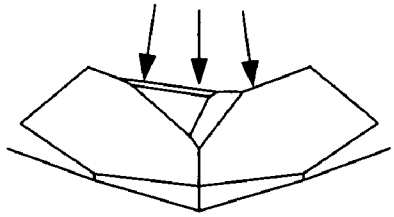

Referring to FIG. 5E, inception of the second secondary star facet 418 may be on middle point of previous secondary star facet 418. The second secondary star facet 418 may be cut from higher than the previous secondary star facet 418. The left point may reach to the center of the bezel 302 and the right point may reach to the center of primary star facet 416. The horizontal rib line of this second secondary star facet 418 may be parallel to table line of previous secondary star facet 418 in order to produce a double table line effect. The middle point of this second secondary star facet 418 may reach to about 50% toward girdle of primary star facet 416. If triple table line is desired, the middle point may reach to about 35% toward girdle of primary star facet 416 and the procedure of the previous second secondary star facet 418 is repeated. Beginning at the middle point of previous secondary star facet 418, the cut is from higher than previous secondary star facet and keeping the horizontal rib line of this secondary star facet 418 parallel to previous horizontal rib line. This provides equal spacing of three horizontal lines at an equal distance. Middle point of this secondary star facet 418 may reach to about 55% toward girdle of primary star facet 416. Referring to FIG. 5F, the finished secondary star facet 418 of FIG. 5E is shown.

Figure 5G:
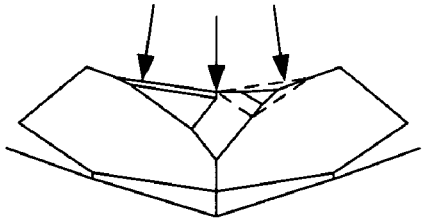
Figure 5H:
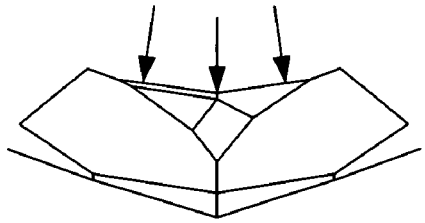

Referring to FIG. 5G, the same procedures as secondary star facets 418 is followed with the exception that the inception of this secondary star facet is on the right point of the primary star facet 416. This secondary star facet 418 is cut from flatter and to the right of primary star facet 416. The cut may be as flat as practically possible so that the middle point drops toward girdle as minimum as possible. The right point reaches approximately about 20% past center of bezel 402. The left point may reach towards the center of primary star facet 416 forming very small vertical rib line when secondary star facet 418 of FIG. 5G "bumps" into secondary star facet of FIGS. 5C and 5D. Referring to FIG. 5H, the finished secondary star facet 418 of FIG. 5G is shown.

Figure 5I:
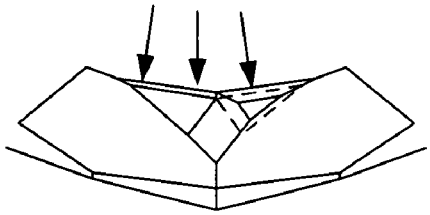
Figure 5J:
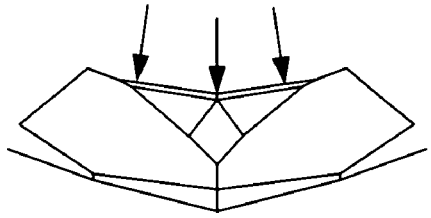

Referring to FIG. 5I, the secondary star facet 418 may be cut following the same procedure as the secondary star facet of FIG. 5E. A triple table line effect may be produced as previously described in FIG. 5G. Referring to FIG. 5J, the finished secondary star facet of FIG. 5I 418 is shown.

The two narrow horizontal rectangular secondary star facets 418 of the star set 414 adjacent to (off) the table may be past the centers of the bezels 402. When star 414 sets on right and left are completed the right and left points of the finished star set 414 may be "bumped" back to centers of bezels 402 forming a very small vertical rib line at the center of each bezel 402. In another embodiment the two narrow rectangular secondary star facets may just reach centers of bezels. Hence there would be no "bumps" between star sets.

Figure 6A:
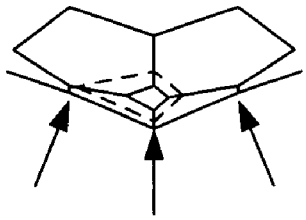
FIG. 6 illustrate the cuts for upper girdle facet sets of the exemplary method.
Figure 6B:
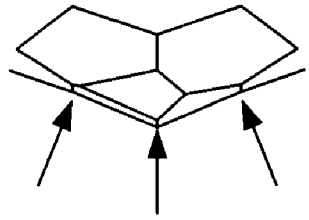

Referring to FIG. 6A, the inception of a first primary upper girdle facet 424 of a pair is shown. The starting point is the point where two girdle lines meet one rib line. The primary upper girdle facet 424 is cut approximately 7° higher than bezels 302. This primary upper girdle facet 424 may be cut from higher and to the right of bezel 302 on left side of aforesaid rib line. The left point reaches about 85%-90% to center of aforesaid bezel 302 (indicated by arrow). There are two middle points. The middle point advancing up the rib line toward the primary star facet 416 touches the point of that primary star facet 416. The other middle point directly below (indicated by arrow) advances into the girdle 406 and reaches into the girdle 406 identically as deep (into girdle) as the middle point of bezel 402. (Point #1 middle point of bezel 402 in the girdle 406) (Point #2 middle point of primary upper girdle facet in the girdle). Eventually, when a line is formed between those 2 points, that line will be parallel to the table 408. As a result the right point ends up approximately 33% to the center of bezel 402 on right side of rib line. Referring to FIG. 6B, the finished first primary 424 upper girdle facet 424 of FIG. 6A is shown.

Figure 6C:
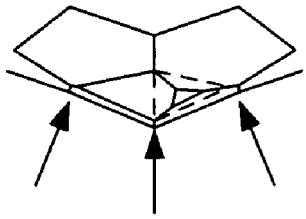
Figure 6D:
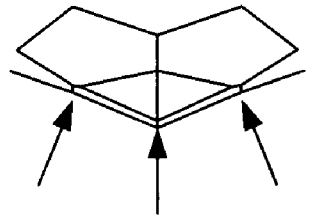

Referring to FIG. 6C, the inception of a second primary upper girdle facet 424 of a pair is on the right point of first primary upper girdle facet 424. The second primary upper girdle facet 424 may be cut from right of first primary upper girdle facet 424 and hence forms a vertical rib line between the two primary upper girdle facets 424. That rib line advances to left to the two middle points of the first primary upper girdle facet 424 (indicated by arrow). The right point of second primary upper girdle facet 424 may reach about 85%-90% to center of bezel 402 on right (indicated by arrow). Referring to FIG. 6D, the finished second primary upper girdle facet 424 of FIG. 6C is shown.

Figure 6E:
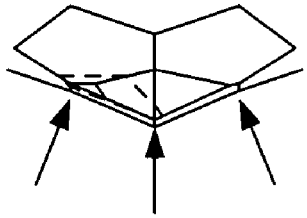
Figure 6F:
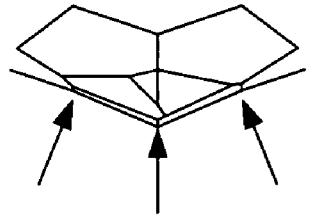

Referring to FIG. 6E, shows the inception of a secondary upper girdle facet 426 which is on the left point of a primary upper girdle facet 424. The secondary upper girdle facet 426 is cut from higher and left of first primary upper girdle facet 424. The cut may be as high as practically possible so that the middle point of this secondary upper girdle facet 426 may not advance more than about 30% up the first primary upper girdle facet 424 and the left point of secondary upper girdle facet 426 reaches 20% past center of bezel 402 (indicated by arrow). The right point reaches past the rib line between two primary upper girdle facets 10% into second primary upper girdle facet 424 on right. Referring to FIG. 6F, the finished secondary upper girdle facet 426 of FIG. 6E is shown.

Figure 6G:
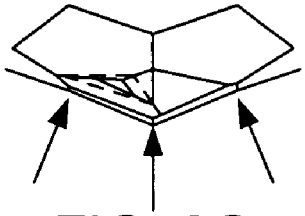
Figure 6H:
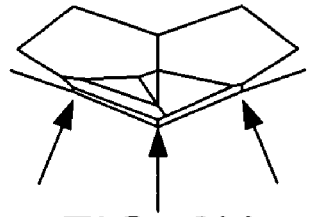

Referring to FIG. 6G, the inception of another secondary upper girdle facet 426 is on middle point of previous secondary upper girdle facet 426. This secondary upper girdle facet 426 may be cut flatter than previous secondary upper girdle facet 426. The left point reaches towards the center of bezel 402 (indicated by arrow). The right point reaches towards the rib line between the two primary upper girdle facets 424 (indicated by arrow). The horizontal rib line of this secondary upper girdle facet 426 may be parallel to girdle line of previous secondary upper girdle facet 426 for double girdle line effect. The middle point of this secondary upper girdle facet 426 reaches approximately 60% up primary upper girdle facet 424. If triple girdle line is desired, the middle point may reach 45% to the primary upper girdle facet 424 and the procedure of previous secondary upper girdle facet 426 may be repeated. It begins at the middle point of secondary upper girdle facet 426 and may be cut flatter than secondary upper girdle facet 426 keeping spacing of three horizontal lines equal. The middle point of this secondary upper girdle facet 426 reaches about 60% up towards the primary upper girdle facet 424. Referring to FIG. 6H, the finished secondary upper girdle facet 426 is shown.

Figure 6I:
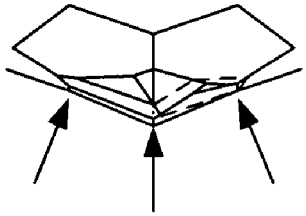
Figure 6J:
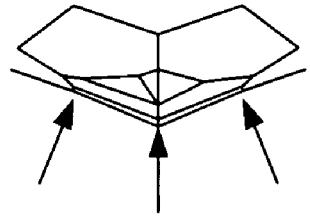

Referring to FIG. 6I, using the same procedure as secondary upper girdle facet 426 of FIG. 6E the inception of this secondary upper girdle facet 426 is on the right point of second primary upper girdle facet 424. This secondary upper girdle facet 426 may be cut from higher and to the right of the second primary upper girdle facet 424. The cut may be as high as practically possible so that the middle point of this secondary upper girdle facet 426 may not advance more than 30% up towards the second primary upper girdle facet 426. The right point of this secondary upper girdle facet 426 reaches 20% past center of bezel 402 (indicated by arrow). The left point reaches towards the rib line between two primary upper girdle facets 424 (indicated by arrow) forming very small vertical rib line, formed when secondary upper girdle facet 426 of FIG. 6I bumps into secondary upper girdle facet 426 of FIG. 6E. Referring to FIG. 6J, the finished secondary upper girdle facet 426 of FIG. 6I is shown.

Figure 6K:
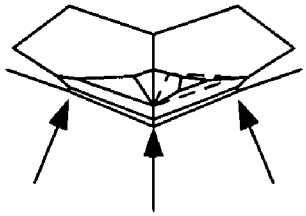
Figure 6L:
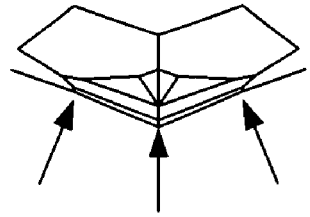

Referring to FIG. 6K, secondary upper girdle facet 426 may be cut following the same procedure as the secondary upper girdle facet 426 of FIG. 6G with the same option for triple lines. Referring to FIG. 6L, the finished secondary upper girdle facet 426 of FIG. 6K is shown. The two narrow rectangular horizontal upper girdle facets adjacent to the girdle may be past the centers of the bezels 402. When upper girdle facet sets on the right and left are completed, the right and left points of finished upper girdle facet sets are "bumped" back to the centers of bezels 402 forming a very small vertical rib line at the center of each bezel 402 (indicated by arrow). In another embodiment the two narrow rectangular horizontal secondary upper girdle facets may be just to the centers of bezels 402. Hence there would be no "bumps" between upper girdle facet sets.

Figure 7A:
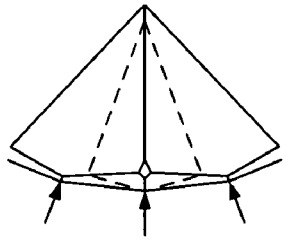
FIG. 7 illustrate the cuts for lower girdle facet sets of the exemplary method.
Figure 7B:
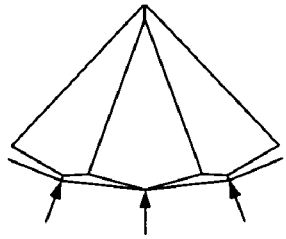

Referring to FIG. 7A, inception of primary lower girdle facet 430 is shown. The starting point is the point where two girdle lines meet or intersect one rib line between two pavilions 310. The primary lower girdle facet 430 may be cut directly between two pavilions 310 approximately 1° higher and approximately 12° to left of pavilion on the right side and 12° to right of pavilion 310 on the left side. Left and right points may reach approximately 60% to center of pavilion 310 (indicated by arrows). There are two middle points. The middle point advancing the rib line toward the culet 312 may reach 90% to the culet 412. The other middle point directly below (indicated by an arrow) advances as deep into the girdle 306 at least identical to the middle point of pavilion 310. Eventually, when a line is formed between those two points; that line will be parallel to the table 408 and the other horizontal lines formed by the upper girdle facet 426 above. In diagrams on FIGS. 7A-7J that latter middle point on primary lower girdle facet 430 advances into the girdle deeper than the middle point of pavilion 310, thus forming a rib line slightly unparallel to the horizontal lines above (see FIG. 5F). This may take off slightly more weight, but may add slightly more life to the stone. Referring to FIG. 7B, the finished primary lower girdle facet 430 of FIG. 7A is shown.

Figure 7C:
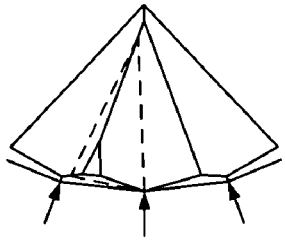
Figure 7D:
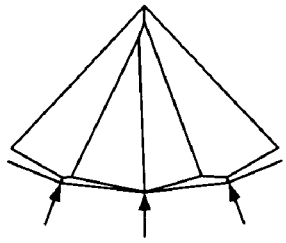

Referring to FIG. 7C, the inception of this secondary lower girdle facet 432 is on the left point of primary lower girdle facet 430. It cuts from left and a bit higher than primary lower girdle facet 430. The left point reaches about 50% of the remaining girdle line (halfway between left point of primary lower girdle facet 430 and center of pavilion (indicated by arrow)). The right point reaches the center of primary lower girdle facet 430 (indicated by arrow) and advances to culet 412 reaching about 90% to point of primary lower girdle facet 430 which is 10% from the culet 412. Referring to FIG. 7D, the finished secondary lower girdle facet 432 of FIG. 7C is shown.

Figure 7E:
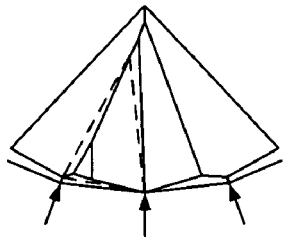
Figure 7F:
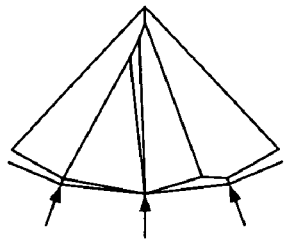

Referring to FIG. 7E, inception of this secondary lower girdle facet 432 is on the left point of previous secondary lower girdle facet 432. The previous procedure may be repeated. It cuts from left and a bit higher onto the previous secondary lower girdle facet 432. The left point reaches towards the center of pavilion 310 (indicated by arrow). The right point reaches the center of primary lower girdle facet 430 (indicated by arrow), together with right rib line of previous secondary lower girdle facet 432. The middle point advancing to culet 412 reaches approximately 80% to point of previous secondary lower girdle facet 432 which reaches approximately 90% to point of primary lower girdle facet 430 which is 10% from culet 412. (this previous procedure may be repeated providing left rib line of FIG. 7E does not reach center of pavilion 310). Referring to FIG. 7F, the finished secondary lower girdle facet 432 of FIG. 7E is shown. The procedures of FIGS. 6E-6G, which results in double girdle line may be applied after primary lower girdle facet 430 of FIGS. 7A and 7B before cutting the secondary girdle facets which would result in double line on bottom.

Figure 7G:
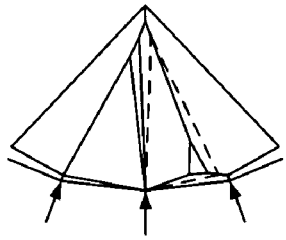
Figure 7H:
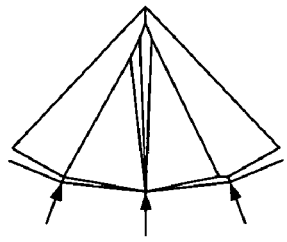

Referring to FIG. 7G, inception of this secondary lower girdle facet 432 is on the right point of primary lower girdle facet 430. It may be cut from right and a bit higher than the primary lower girdle facet 430. The right point reaches approximately 50% of the remaining girdle line (halfway between right point of primary lower girdle facet 430 and center of pavilion 310 (indicated by arrow). The left point reaches center of primary lower girdle facet 430 (indicated by arrow) together with two rib lines of previous two secondary lower girdle facets, and point advancing to culet 412 reaches 90% to point of primary lower girdle facet 430 which is 10% from culet 412. Referring to FIG. 7H, the finished secondary lower girdle facet 432 of FIG. 7G is shown.

Figure 7I:
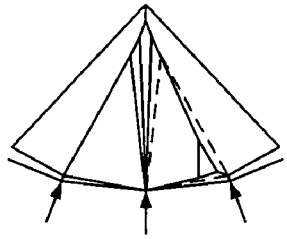
Figure 7J:
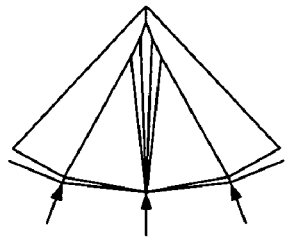

Referring to FIG. 7I, inception of this secondary lower girdle facet 432 is on the right point of previous secondary lower girdle facet 432 and previous procedure is repeated. It cuts from right and a bit higher onto previous secondary lower girdle facet 432. The right point reaches to the center of pavilion (indicated by arrow). The left point reaches to the center of primary lower girdle facet 430 (indicated by arrow) together with two rib lines of previous three secondary lower girdle facets. The point advancing to culet 412 reaches approximately 80% of previous secondary lower girdle facet 432 which reaches approximately 90% to point of primary girdle facet 430 which is 10% from culet 412. It is possible to repeat this procedure numerous times as was explained in directions to diagram FIG. 7E providing rib lines of FIGS. 7E and 7I do not reach center of pavilion. The less blocking facets on the diamond, the more times the procedure can be repeated on the diamond. The procedures of FIGS. 6I-6K, which results in double girdle line, may be applied after the primary girdle facet 430 of FIGS. 7A and 7B before cutting the secondary girdle facets which would result in double girdle line on bottom. FIGS. 7C and 7G may reach centers of their respective pavilions eliminating FIGS. 7E and 7I. In this case the lower girdle facet set would comprise one primary lower girdle facet and two secondary lower girdle facets. Referring to FIG. 7J, the finished secondary facet of FIG. 7I 432 is shown.

The inception of this Secondary Lower Girdle Facet (S.L.G.F.) may be on left point of primary lower girdle facet. It cuts from left and a bit higher than primary lower girdle facet. Left point reaches center of pavilion on left. Right point reaches center of primary lower girdle facet, and middle point advancing toward culet may reach approx. 85% to middle point of primary lower girdle facet which may reach approx. 95% to culet. The inception of this S.L.G.F. is on right point of P.L.G.F. It cuts from right and a bit higher than P.L.G.F. Right point reaches center of pavilion on right. Left point reaches right point of previous S.L.G.F. at center of P.L.G.F., and middle point advancing toward culet may reach approximately 85% to middle point of P.L.G.F. identically to S.L.G.F. on left. In another embodiment of a lower girdle facet set the first secondary lower girdle facet may be cut as high as practically possible identically to secondary upper girdle facet. The inception of this Secondary Lower Girdle Facet (S.L.G.F.) may be on left point of Primary Lower Girdle Facet (P.L.G.F.). This S.L.G.F. may be cut as high as practically possible so that middle point advances up left rib line of Primary Lower Girdle Facet as minimum as possible. Left point of this S.L.G.F. may reach from 10 to 20% past center of pavilion on left (indicated by arrow), and right point may reach from 10 to 20% past center of P.L.G.F. (indicated by arrow).

Inception of this Secondary Lower Girdle Facet may be on middle point of previous S.L.G.F. It is cut from flatter than previous S.L.G.F. Left point reaches center of pavilion on left. Right point reaches center of P.L.G.F. The horizontal rib line formed between right and left points of this S.L.G.F. may be parallel to girdle line of previous S.L.G.F. giving double girdle line effect. Middle point of this S.L.G.F. may reach approximately 85% to middle point of P.L.G.F. which may reach approximately 95% to culet. This Secondary Lower Girdle Facet may be cut identically to first S.L.G.F. of this embodiment except that inception of this S.L.G.F. is on right point of P.L.G.F., right point reaches 10 to 20% past center of pavilion on right and left point reaches center of P.L.G.F. forming small vertical rib line as present Secondary Lower Girdle Facet (e) bumps into S.L.G.F. (a) of this embodiment (f) finished S.L.G.F. Inception of this S.L.G.F. is on middle point of previous S.L.G.F. It is cut from flatter than previous S.L.G.F. Right point reaches center of pavilion on right. Left point reaches right point of finished S.L.G.F. (d) at center of P.L.G.F. The horizontal formed between left and right points of this S.L.G.F. may be parallel to girdle line of previous S.L.G.F. giving double girdle line effect. Middle point of this S.L.G.F. advancing toward culet may reach approximately 85% to middle point of P.L.G.F. identically to finished S.L.G.F. on left. The two narrow horizontal Secondary Lower Girdle Facets of lower girdle facet set off the girdle are past the centers of their respective pavilion or right and left. When lower girdle facets on right and left are completed the right and left points of previously completed lower girdle facet set are bumped back to centers of pavilions on right and left forming a small vertical rib line at centers of the pavilions.

Figure 13:
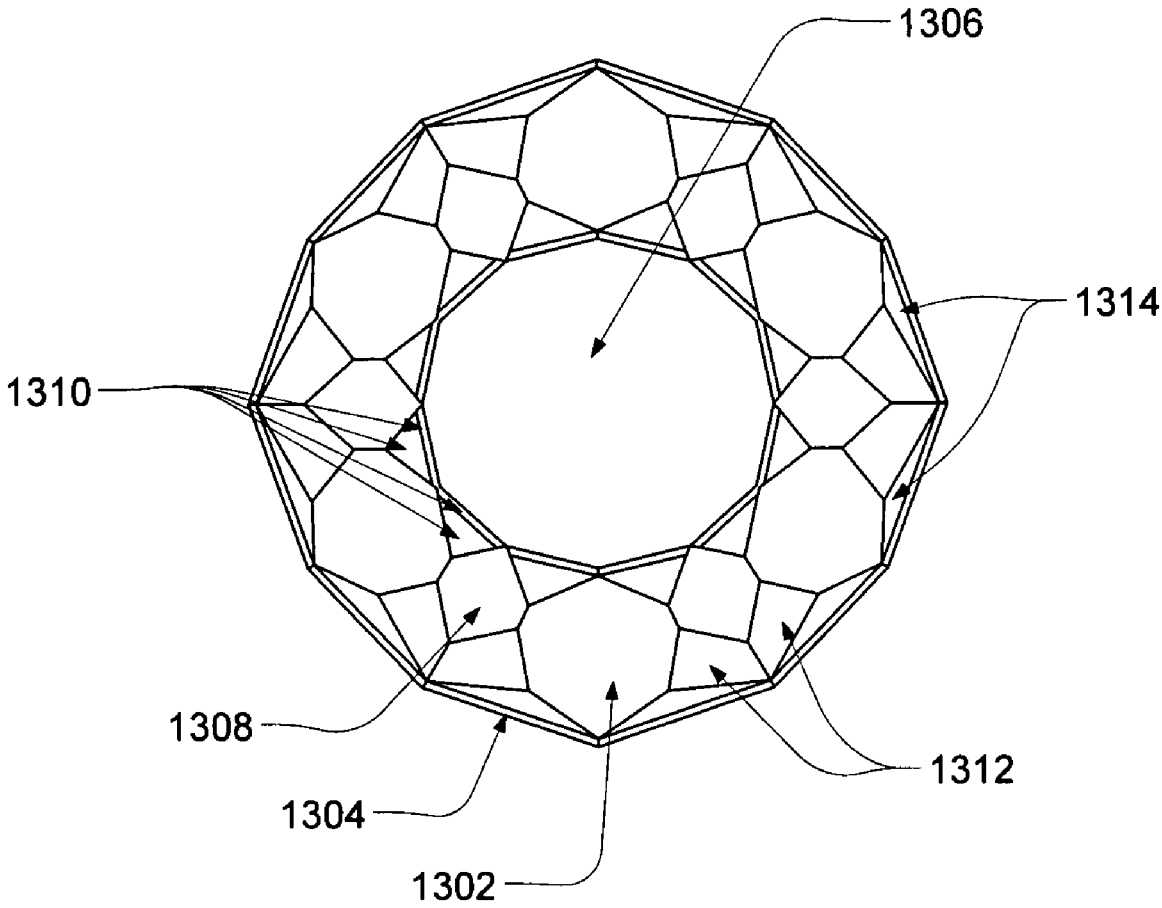
Figure 14:
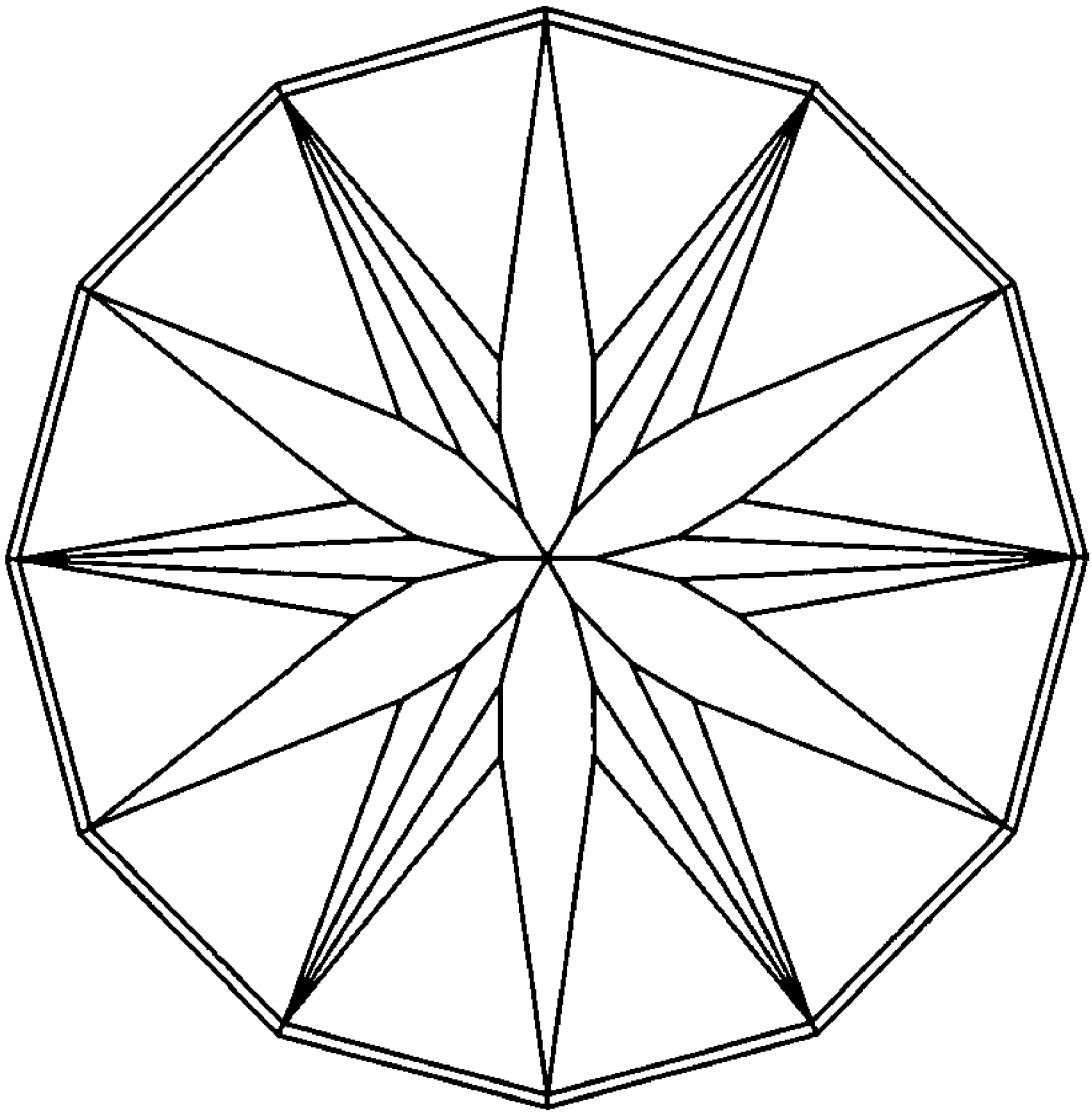

A third exemplary embodiment of a blocked stone may be an exemplary gemstone cut from a rough diamond with the crown having a table surrounded by six star sets. The six star sets may be surrounded by six bezel facets each bent away 60° from the adjacent bezel unlike the exemplary gemstone that may be cut from a round stone which has eight bezels each bent away 45° from the adjacent bezel. The six bezel facets may be surrounded by six pairs of upper girdle facet sets each set consisting of two primary girdle facets and just two secondary girdle facets (in this embodiment there are no narrow rectangular secondary upper girdle facets). In this embodiment each star set has one primary star and four secondary stars like the previous exemplary gemstone of 8 bezels and 8 pavilions (8 counts) cut from a round stone, but unlike that stone the primary star on this new embodiment may also be referred to as a secondary bezel facet. This being since normally star facets do not reach girdle just as upper girdle facets do not reach table, i.e., brilliandeering facets do not reach from table to girdle. Being that in the initial forming of the "primary star facet" in this new embodiment this facet reaches into the table and into the girdle as shown 1108, this facet may be referred to a secondary bezel. The four secondary star facets of each star set in this embodiment may be cut identically to the four secondary facets of the previous 8 count exemplary gemstone that may be cut from a round stone, two of those secondary star facets being narrow rectangular facets. In this embodiment the bottom is identical to the bottom of the previous 8 count gemstone that may be cut from the round stone except that instead of eight pavilions each bent away from the adjacent pavilions 45° there are six pavilions each bent away from the adjacent pavilion 60°. Like the exemplary gemstone of 8 count that may be cut from the round stone these six pavilions are line up directly underneath the six bezels and the lower bottom girdle facet sets are identical to the lower girdle facet sets on the previous exemplary gemstone of 8 count that may be cut from the round stone except on this new embodiment they may reach nearer to culet and may have added secondary lower girdle facets being that there is less blocking as discussed. In this embodiment there may be 12 narrow rectangular girdle facets adjacent parallel and lined up with the twelve narrow triangular secondary upper girdle facets. Each girdle facet equally bent away from the other creating a circle of narrow rectangular girdle facets each bent away 30° from the next as shown in FIG. 13. Finally in this embodiment the twelve narrow rectangular secondary star facets (or the 24 narrow rectangular secondary star facets if the triple table line is in effect) may be parallel and lined up with the twelve girdle facets thus creating a smaller inner circle of table lines each bent away from the next 30° as shown in FIG. 13 parallel and lined up with the larger outer circle of girdle lines.

In another embodiment there may be a triple table line effect by adding one narrow rectangular secondary star facet directly underneath lining up and parallel to each of the two narrow rectangular secondary star facets as a result creating a total of six secondary star facets in each of the six star sets identical to the previous exemplary gemstone from the round stone with eight star sets.

In another embodiment the narrow rectangular secondary star facets "bump" into narrow rectangular secondary star facets of adjacent star sets at the center of bezels, identically to narrow rectangular secondary star facets on the exemplary gemstone of 8 count that may be cut from a round stone, but unlike that latter gemstone, the two narrow rectangular secondary star facets in a star set just touch, but do not "bump" into each other at the center of the primary star facet, as shown in FIG. 13. (This allows slightly more white light in star sets and in table).

Figure 10:
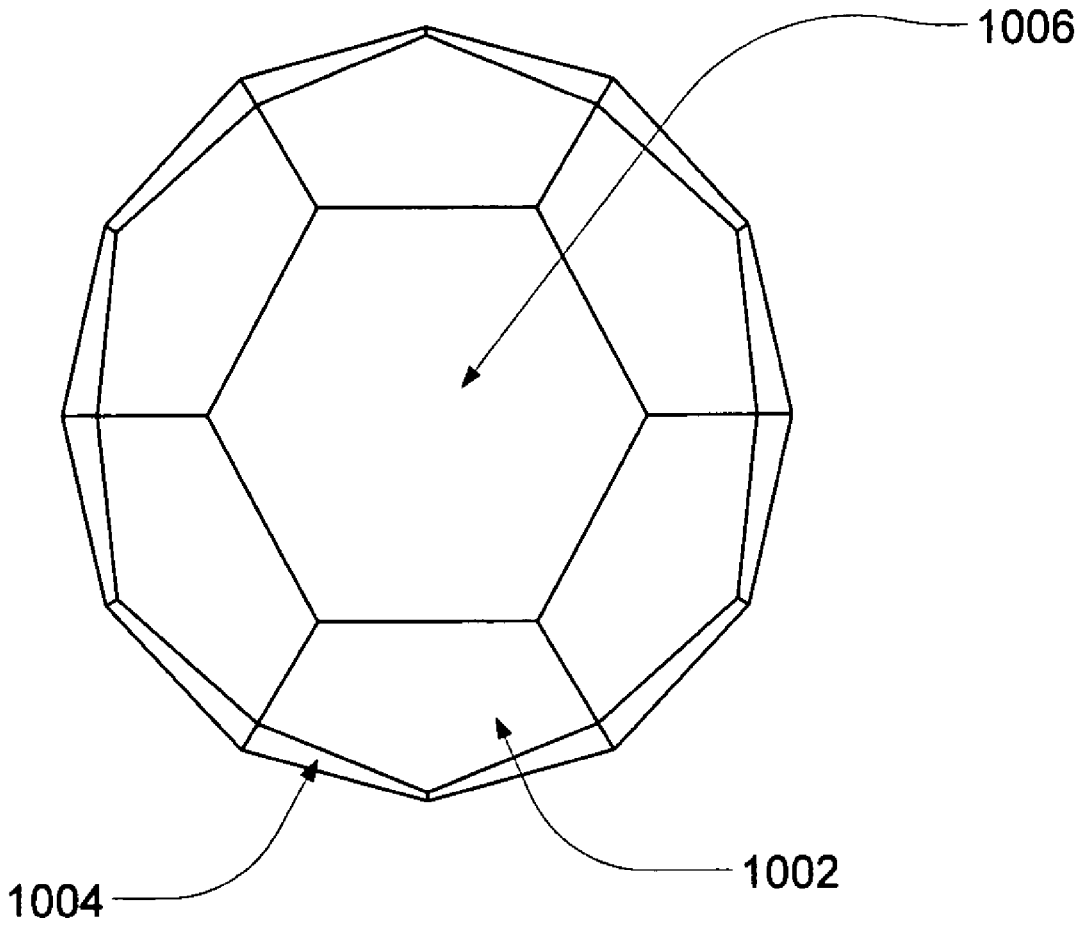
Figure 11:
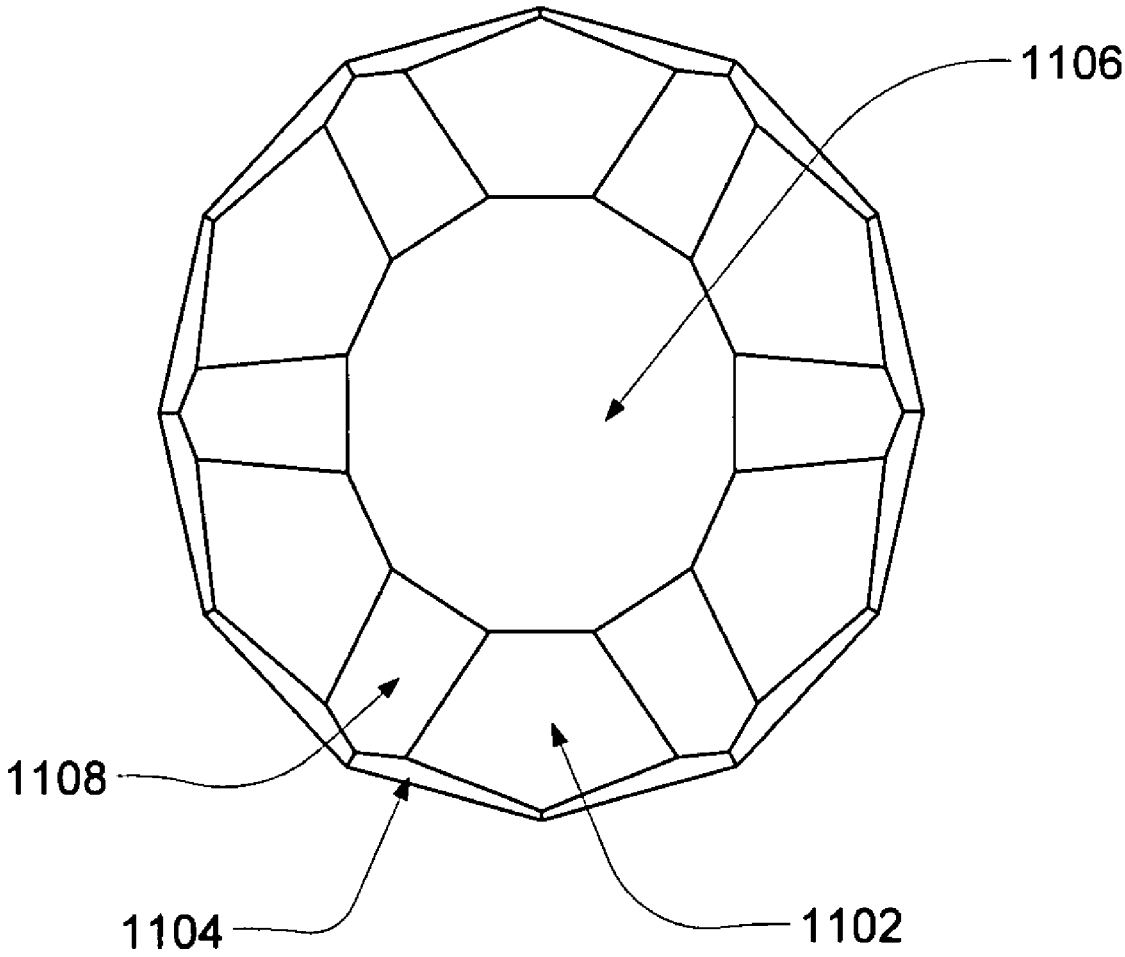
Figure 16A:
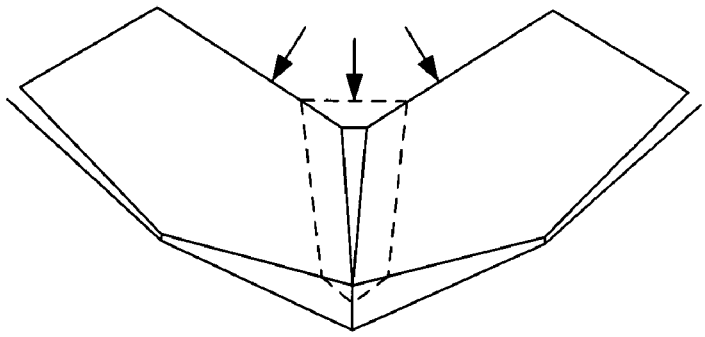
FIGS. 16A-18B illustrate the cuts for a star set of that exemplary method which may also be for exemplary method of FIGS. 3A-3B.

Referring to FIG. 16A, inception of the primary star facet 1308 or in a third embodiment which may also be referred as secondary bezel facet 1108 as explained above regarding S.L.G.F. and P.L.G.F., the starting point is where two table lines meet one rib line. See FIG. 10. The starting point of this primary star facet 1308 is cut directly between two bezels 1102 approximately 3 or 4 degrees flatter then bezels 1102. Although the starting point of this primary star facet 1308 is where two table lines meet one rib line this facet cut onto all the points of that rib line almost simultaneously. If this facet would cut onto all the points of that rib line simultaneously the two new rib lines on right and left of the previous rib line would be parallel to each other and the new facet forming between them would not be wider above than below or visa versa, but being that this primary star facet 1308 does begin on above point of aforesaid rib line (between two bezels 1102) slightly before all the below points on that rib line the two new rib lines are slightly unparallel and the new facet formed between them is slightly wider above than below. Being that this facet is ever so slightly wider above than below, even though the starting point is above, between the two table lines of the bezels, this primary star facet 1308 advances ever so quickly to the girdle and the two points on the girdle lines begin their advance toward the center of their respective girdle facets (indicated by arrows) ever so slightly after the two points above begin their advance toward the center of their respective table lines (indicated by arrows). This primary star facet 1308 (or secondary bezel facet 1108) is finished when two points above reach approximately ¾ to the center of their respective table lines (indicated by arrows) and the two points below reach approximately halfway to the center of their respective girdle facets (indicated by arrows).

Figure 16B:
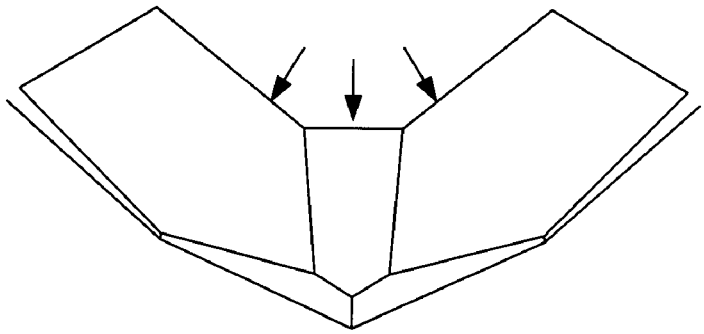

Referring to FIG. 16B the finished primary star facet of FIG. 16A is shown.

Figure 16C:
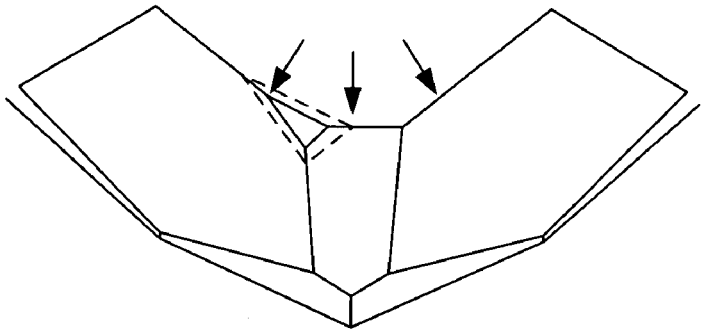
Figure 16D:
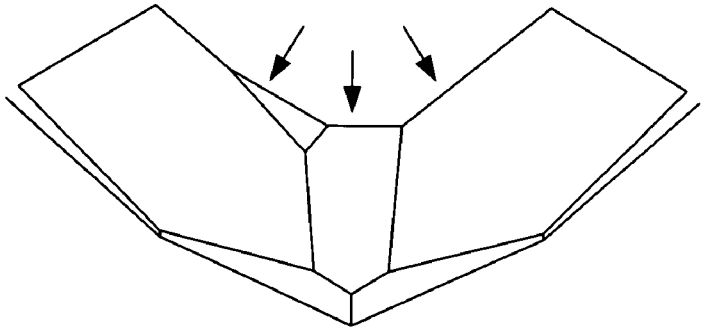

Referring to FIG. 16C, see the discussion above regarding FIGS. 5A and 5B. Cut may be identical except that right point may reach just to the center of the primary star facet 1308. Referring to FIG. 16D, the finished secondary star facet 1310 of FIG. 16C is shown.

Figure 17E:
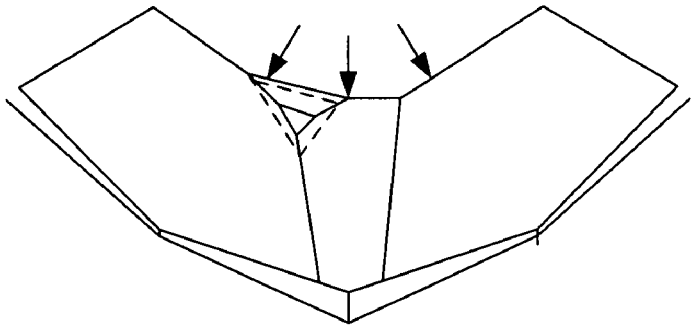
Figure 17F:
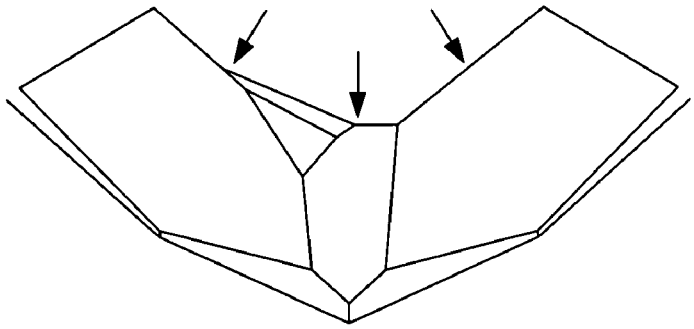

Referring to FIG. 17E, see the discussion above regarding FIGS. 5C and 5D. Referring to FIG. 17F a finished secondary star facet 1310 of FIG. 17E is shown. The secondary star facet may be cut as flat as practically possible so that the middle point reaches as minimum as possible toward the girdle, allowing more light in the table.

Figure 17G:
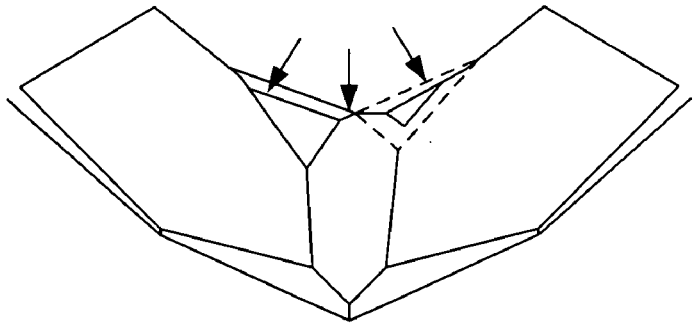
Figure 17H:
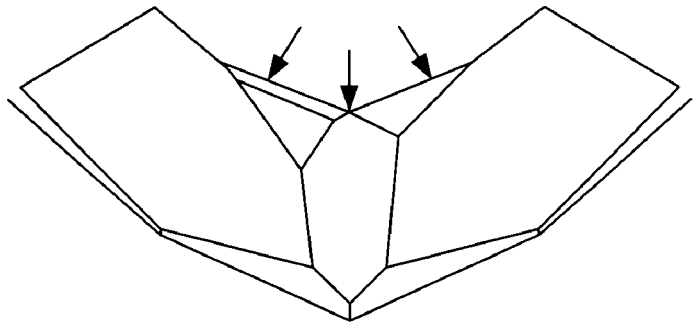

Referring to FIG. 17G, see the discussion above regarding FIGS. 5E and 5F. Cut may be an identical cut except that the left point reaches just to the center of the primary star facet 1308 eliminating a bump at the center of the primary star facet 1308 allowing more white light in the star sets and in the table as discussed above regarding S.L.G.F. Referring to FIG. 17H a finished secondary star facet 1310 of FIG. 17G is shown.

Figure 18I:
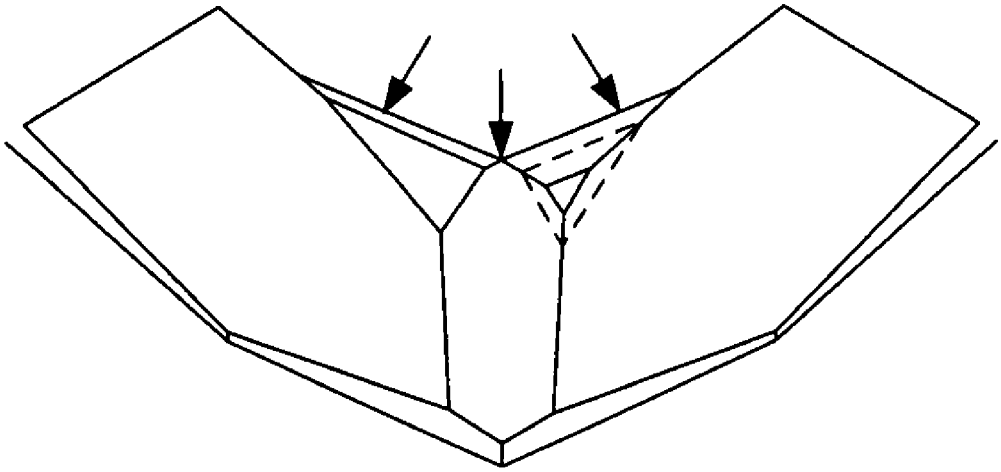
Figure 18J:
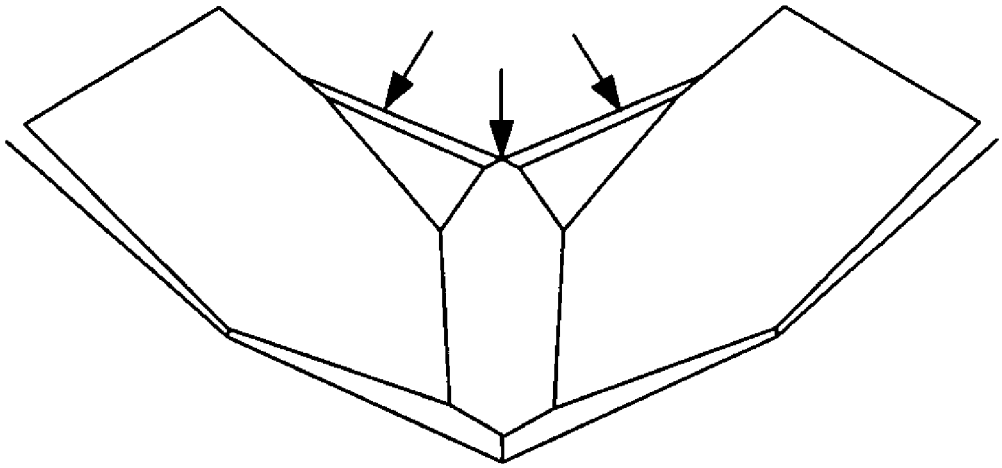

Referring to FIG. 18I, see the discussion above regarding FIG. 5G. Referring to FIG. 18J a finished secondary star facet 1310 of FIG. 18I is shown. See also the discussion above regarding FIGS. 16C and 16D. Another embodiment may be the star sets as having no narrow rectangular secondary star facets above triangular secondary star facets leaving a star set with one primary star facet and just two secondary star facets eliminating the double table line effect.

Figure 19A:
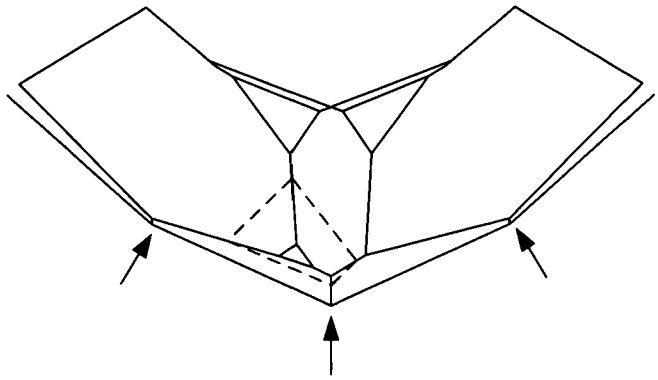
FIGS. 19-20 illustrate the cuts for a upper girdle facet set onto the primary star facet of the aforementioned star set of the exemplary method.
Figure 19B:
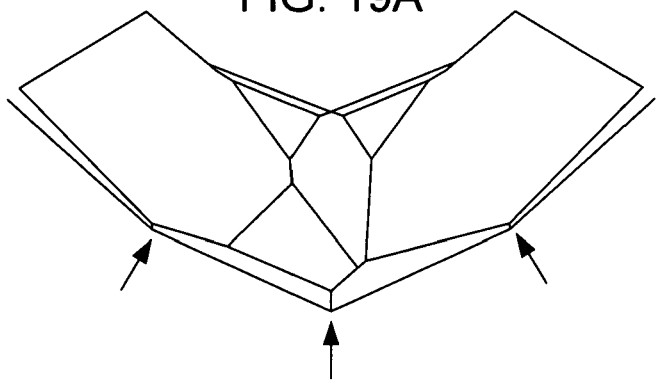

Referring to FIG. 19A the inception of a first primary upper girdle facet 1312 is shown. The starting point of this primary upper girdle facet 1312 may be the left rib line of the primary star facet 1308 (or secondary bezel facet 1108) where the girdle line of that latter facet meets the girdle line of the bezel on left. This facet may be cut from left and higher of primary star facet 1308. This primary upper girdle facet 1312 begins as a triangle at inception and ends as a polygon (four sided and no parallel lines). The right point of the triangle formed at inception reaches center of the primary star facet 1308 (indicated by arrow) then develops into a rib line (hence developing from triangle to polygon) as the facet progresses. The right point of this newly developed aforesaid rib line may reach almost to or actually to the right rib line of the primary star facet 1308 or secondary bezel 1108, and the left point of this same newly developed rib line advances ever so slightly into girdle at the center of the primary star facet 1308 (indicated by arrow). See the discussion above regarding FIGS. 5A to 5J about this middle point and middle point of bezel. The middle point of the triangle formed at inception (now a polygon) advances up the rib line of primary star facet 1308 anywhere from approximately 70% toward the above secondary star facet to actually touching the above secondary star facet. The left point of the triangle formed at inception (now a polygon) may reach 65% to center of bezel on left (indicated by arrow) referring to FIG. 19B the finished primary upper girdle facet 1312 of FIG. 19A is shown.

Figure 19C:
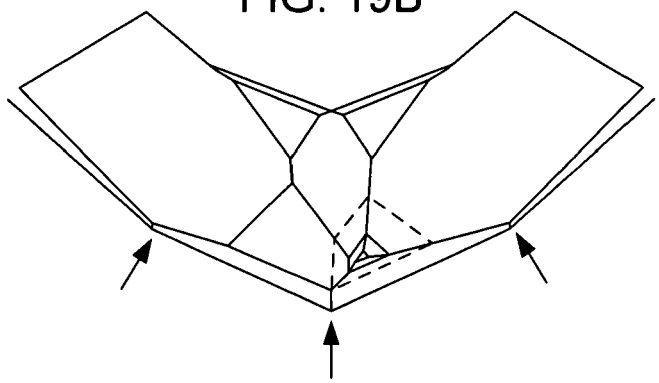
Figure 19D:
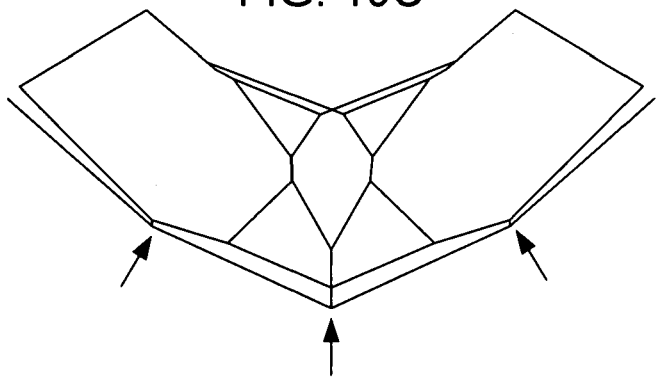

Referring to FIG. 19C the inception of a second primary upper girdle facet 1312. The starting point is on right rib line of the primary star facet 1308 or secondary bezel facet 1108 where girdle line of that latter facet meets girdle line of bezel on right. This facet may be cut from right and higher of primary star facet 1308. This second primary girdle facet 1312 may begin as a triangle at inception immediately developing into a polygon as left point "bumps" into right point of first primary girdle facet 1312 hence that left point developed into rib line. This latter rib line may be a vertical rib line. This vertical rib line advances to the left into first primary upper girdle facet 1312 and may reach up to center of primary star facet 1308 (indicated by arrow). The middle point of this second primary upper girdle facet 1312 advances up the rib line of primary star facet 1308 anywhere from approximately 70% toward the above secondary star facet 1310 to actually touching the above secondary star facet 1310. The right point of this second primary upper girdle facet 1312 may reach 65% to center of bezel 1302 on right (indicated by arrow). Referring to FIG. 19D, the finished primary upper girdle facet 1312 of FIG. 19C is shown.

Figure 20E:
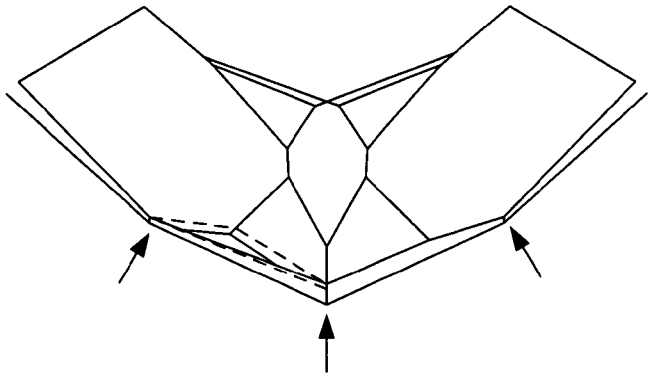
Figure 20F:
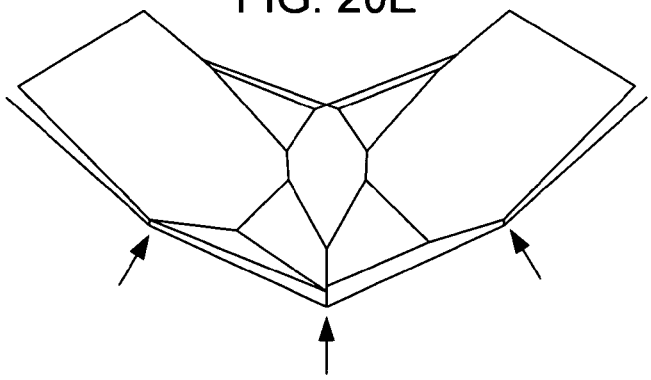

Referring to FIG. 20E the inception of a secondary upper girdle facet 1314 is shown. The starting point is on left point of left primary upper girdle facet 1312. This facet may be cut from higher and a bit left of primary upper girdle facet 1312. This secondary upper girdle facet 1314 may be cut as high as practically possible so that the middle point advances up left rib line of left primary upper girdle facet 1312 as minimum as possible. The right point may reach up to the vertical rib line between two primary girdle facets 1312 at center of primary star facet 1308 at right end of girdle facet 1304 (indicated by arrow). The left point of this secondary upper girdle facet 1314 may reach up to center of bezel 1302 on left at left end of girdle facet 1304 (indicated by arrow). Referring to FIG. 20F, the finished secondary upper girdle facet 1314 of FIG. 20E is shown.

Figure 20G:
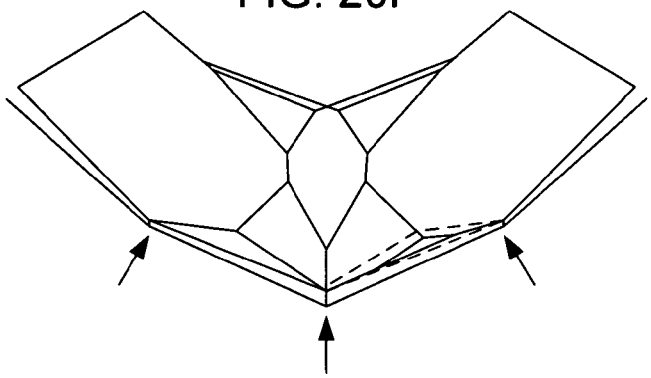
Figure 20H:
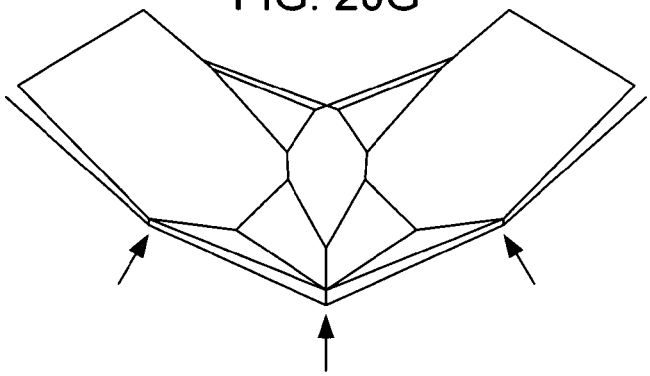
Figure 21A:
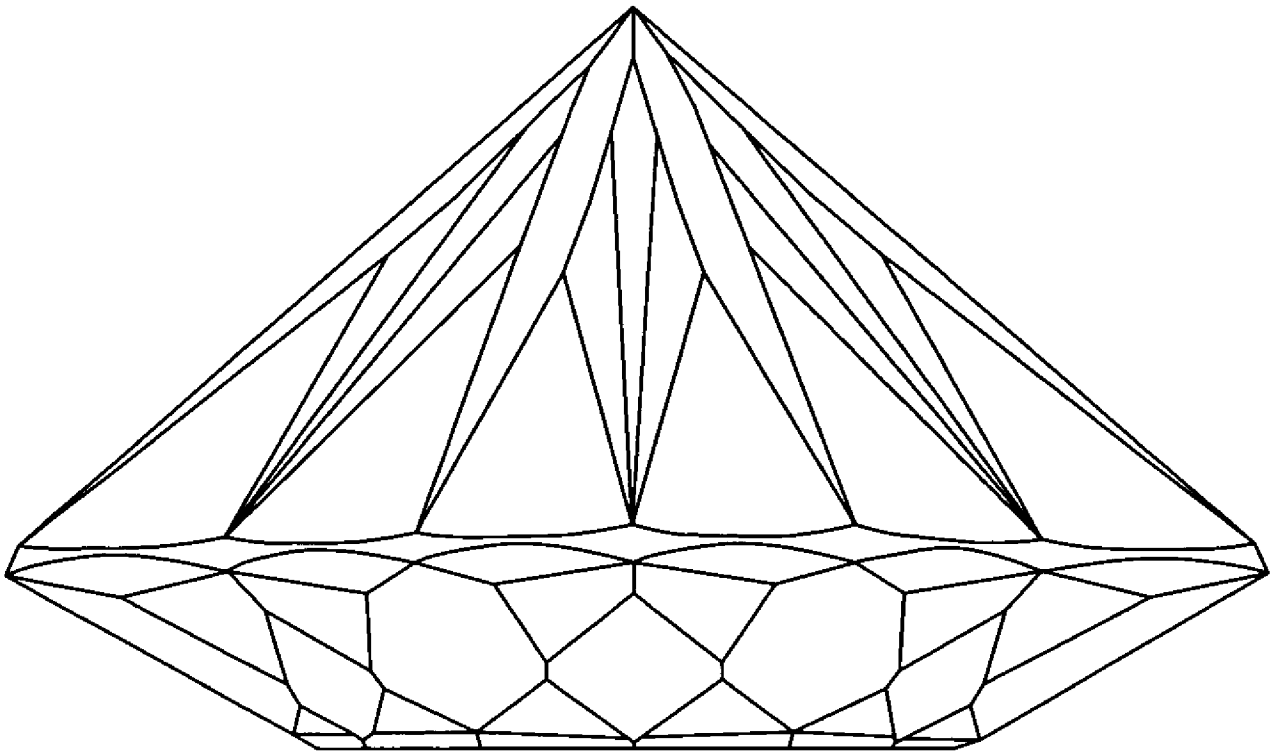
FIGS. 21-24 illustrate exemplary cuts.
Figure 21B:
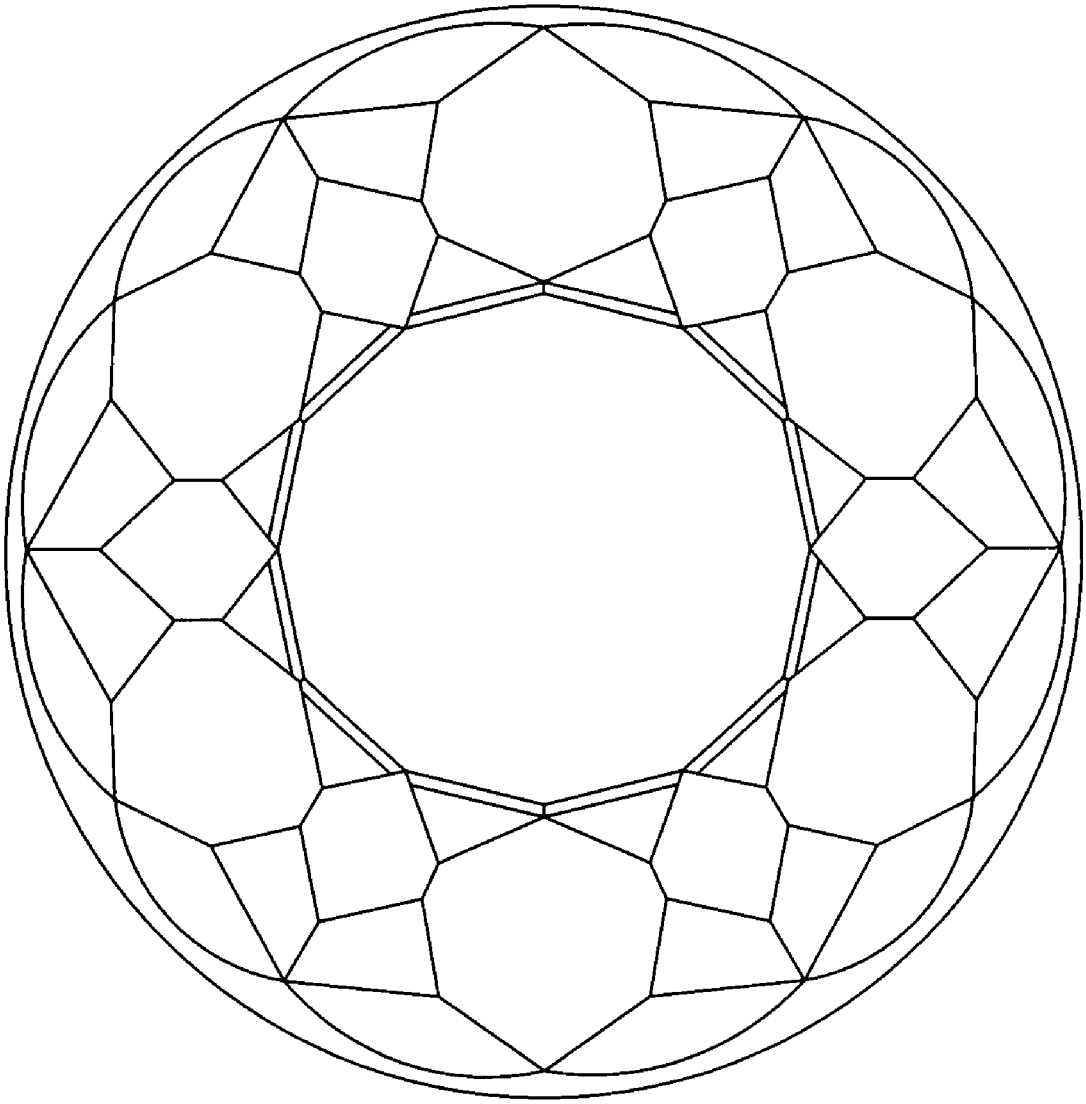
Figure 21C:
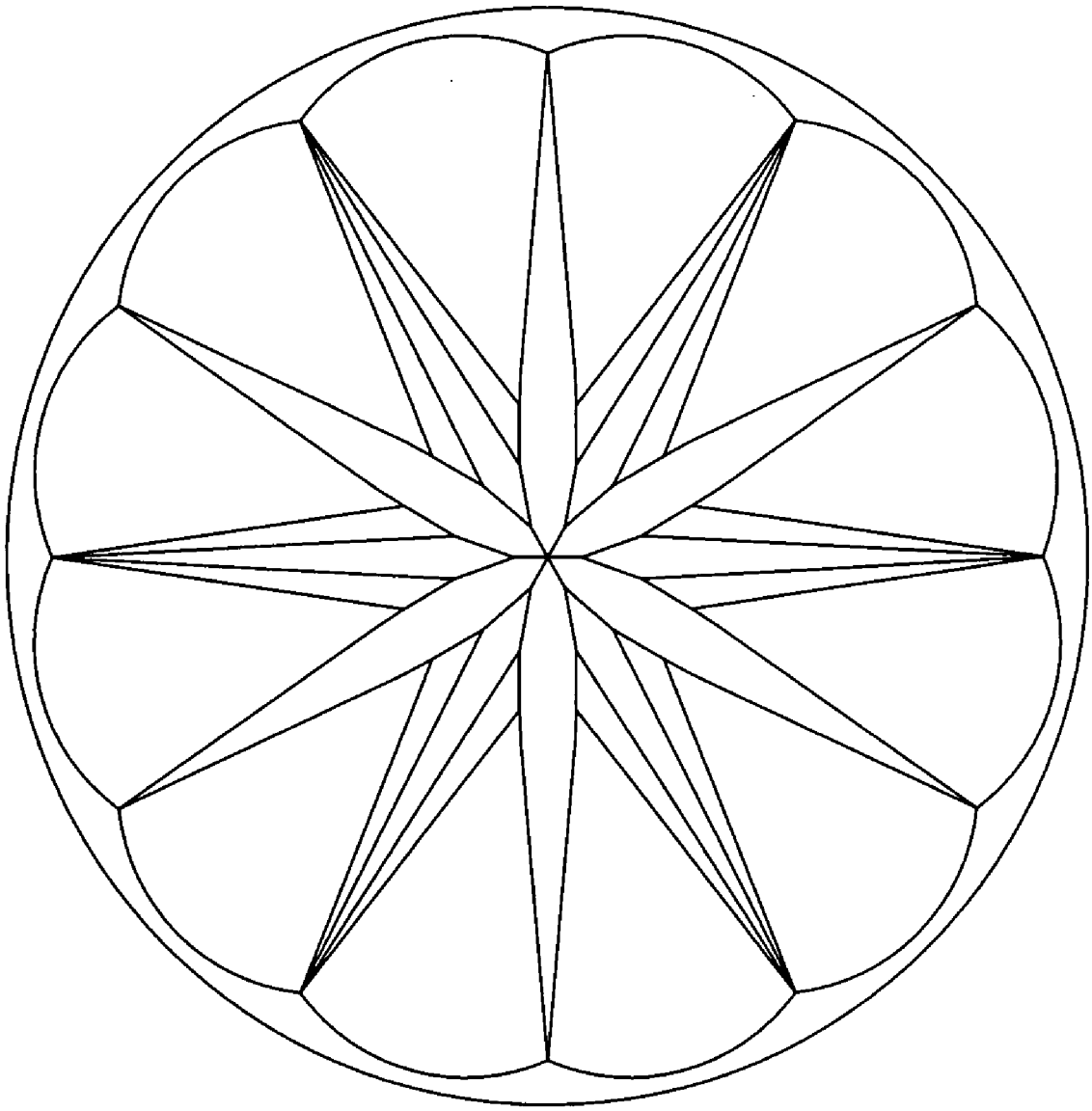
Figure 22A:
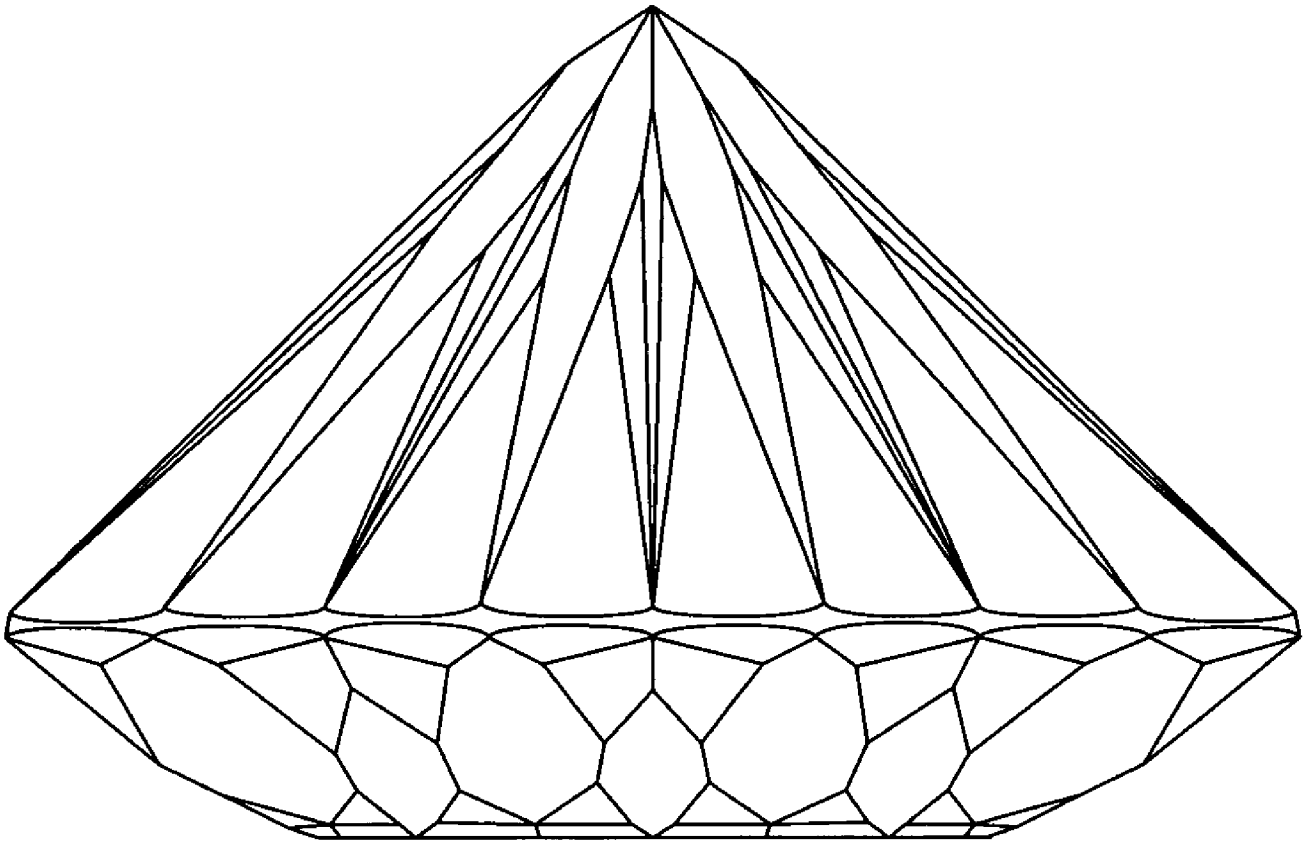
Figure 22B:
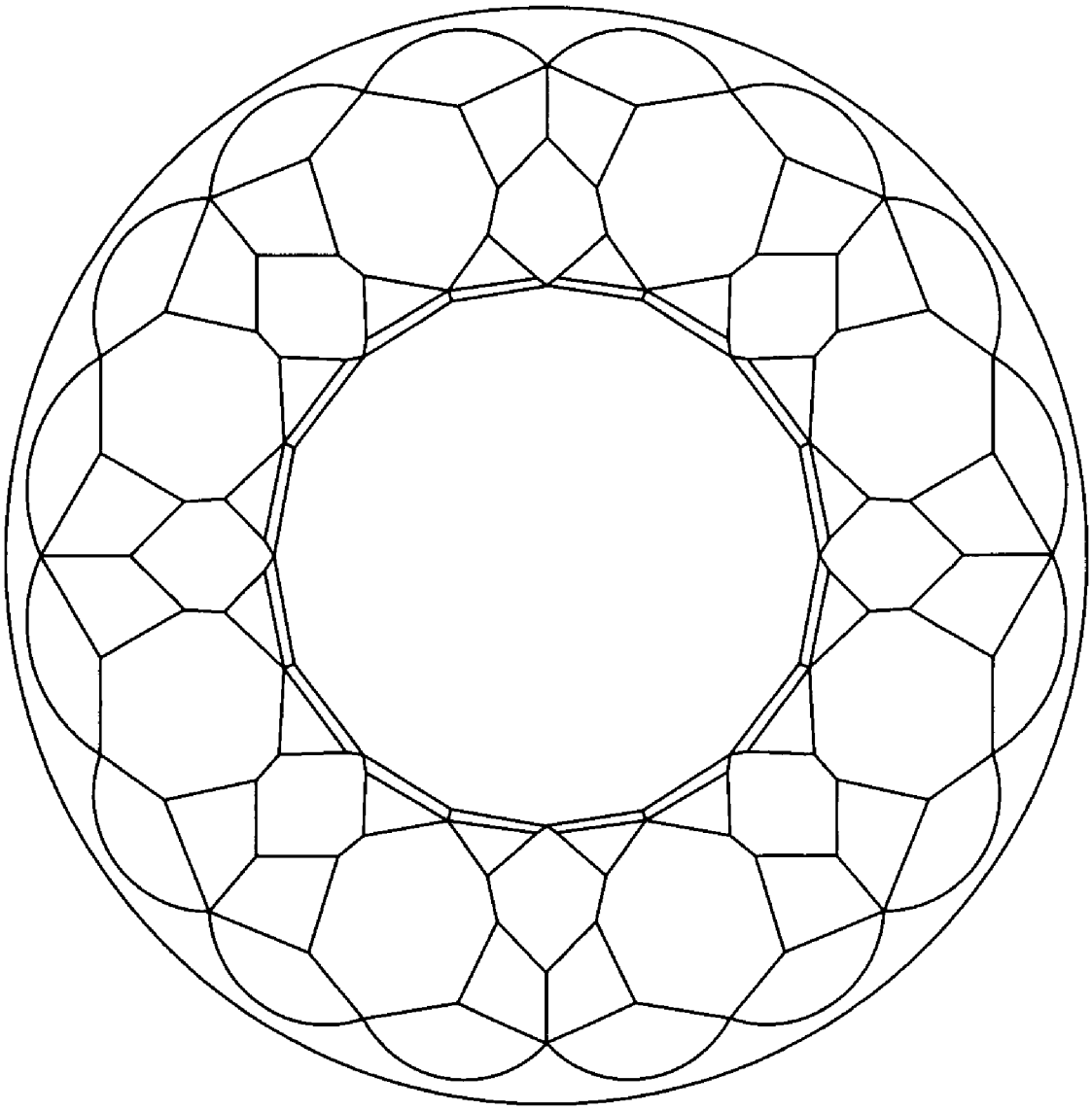
Figure 22C:
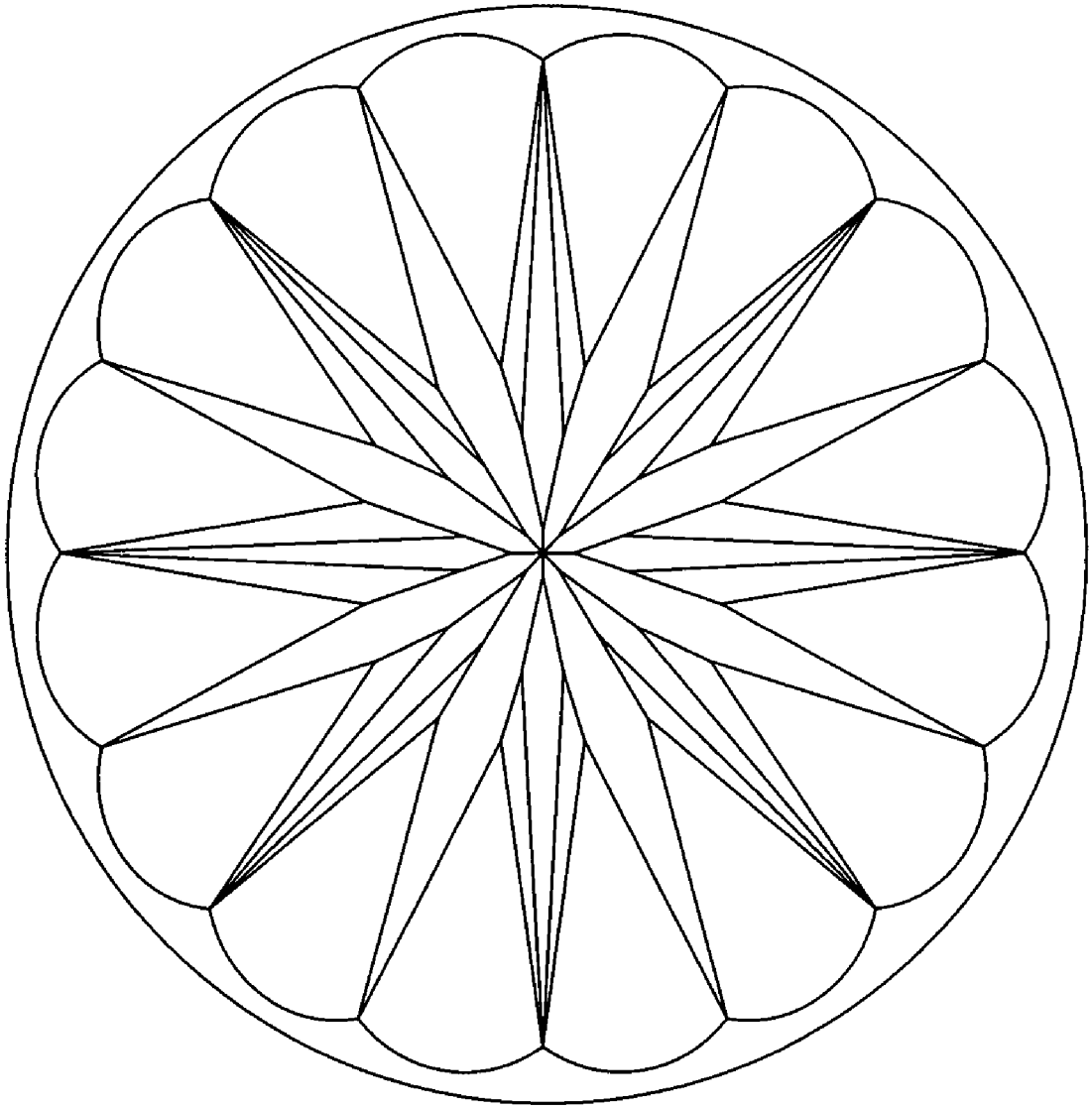
Figure 23A:
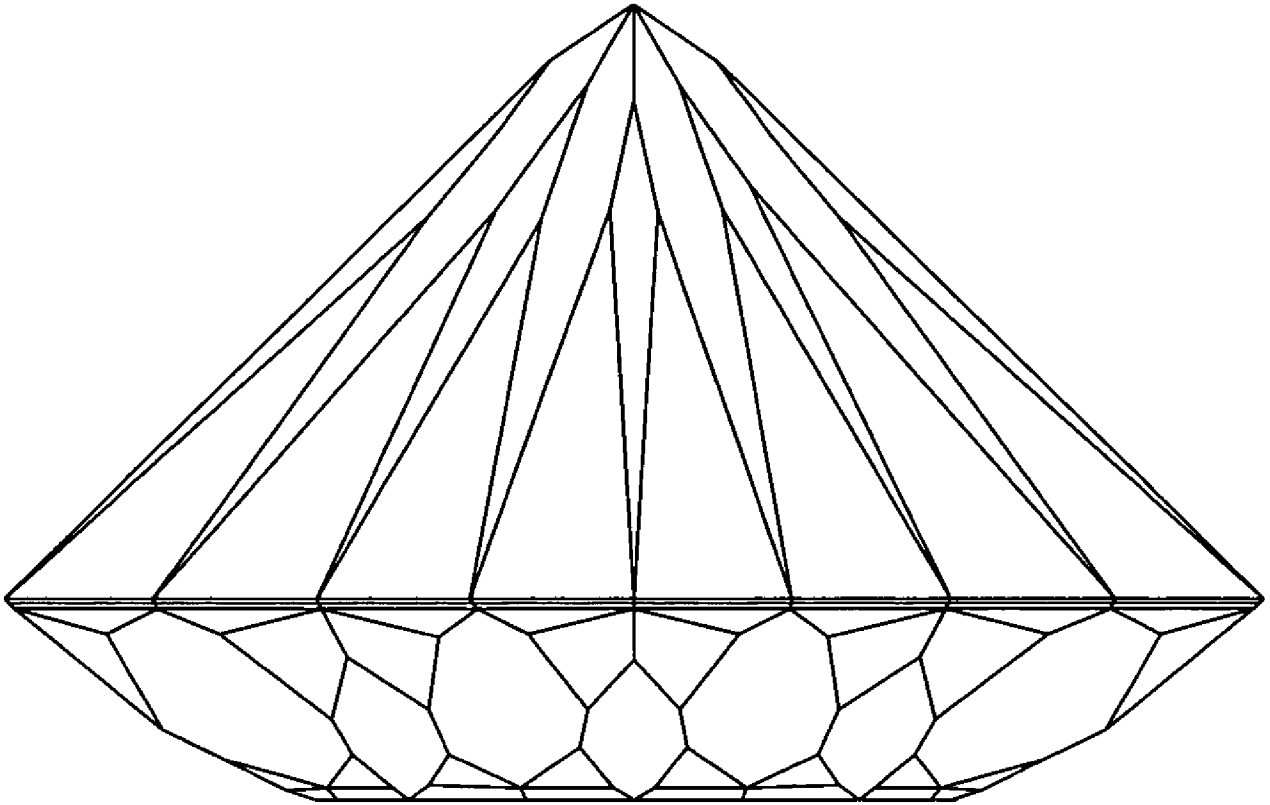
Figure 23B:
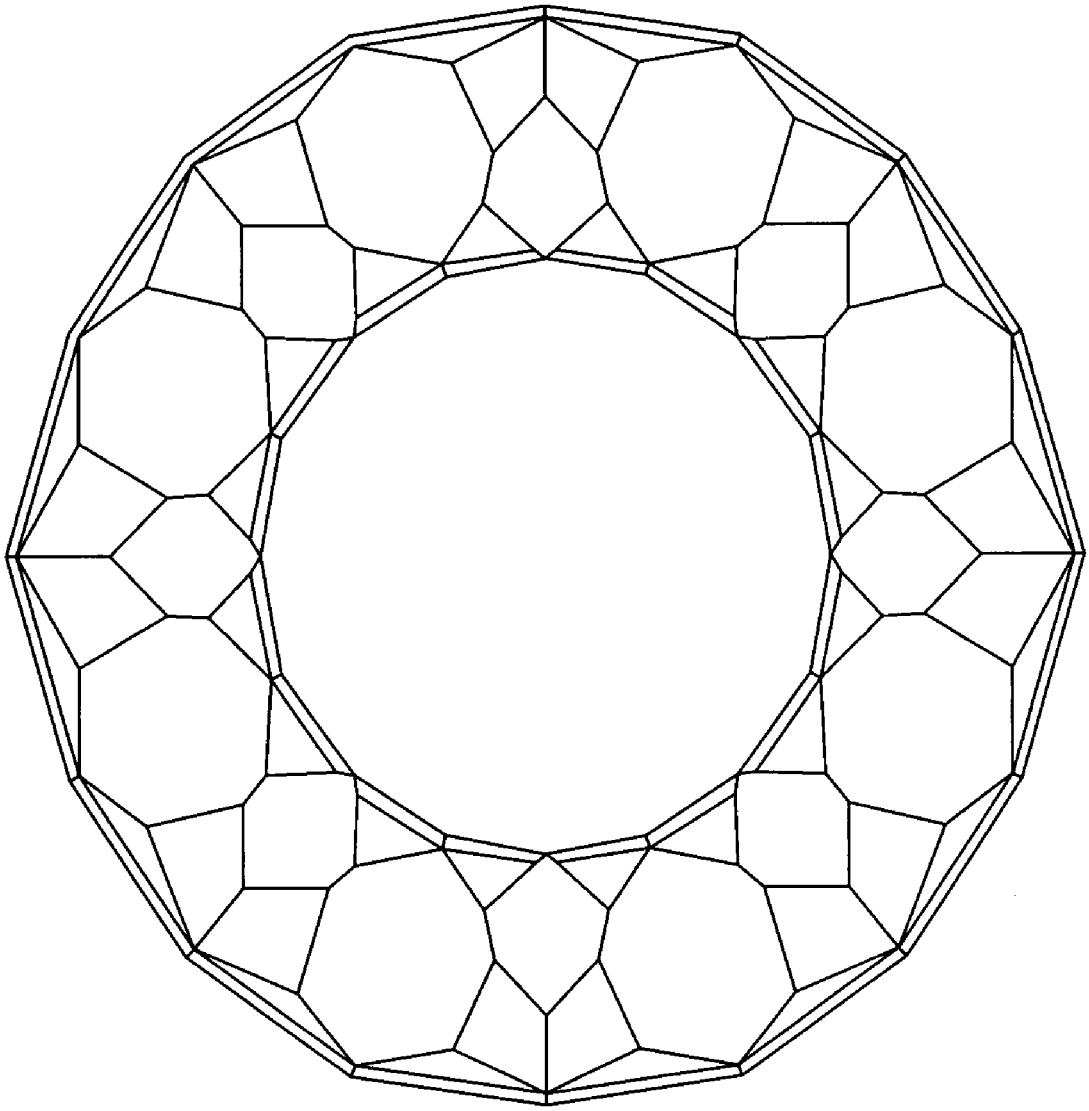
Figure 23C:
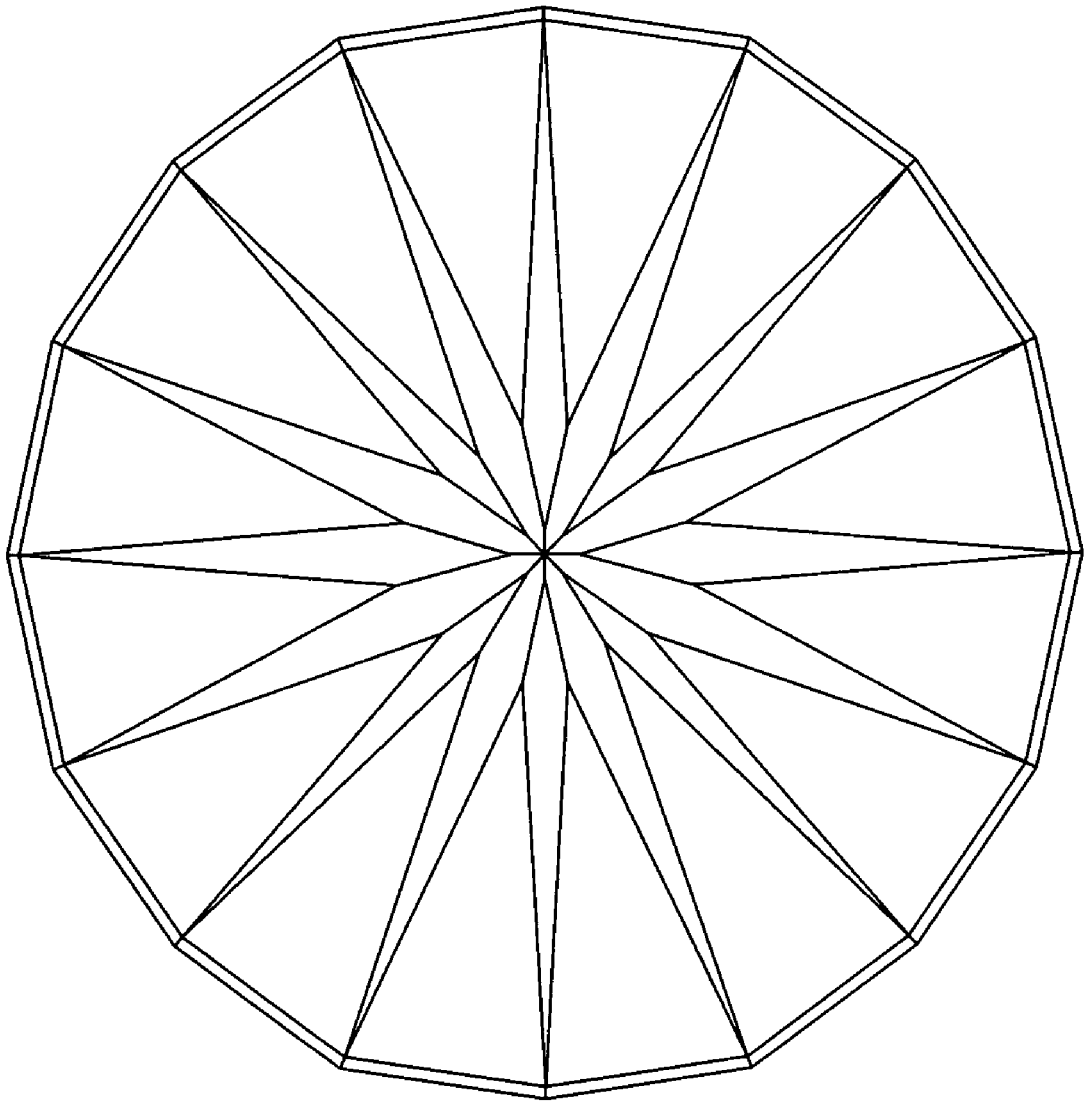
Figure 24A:
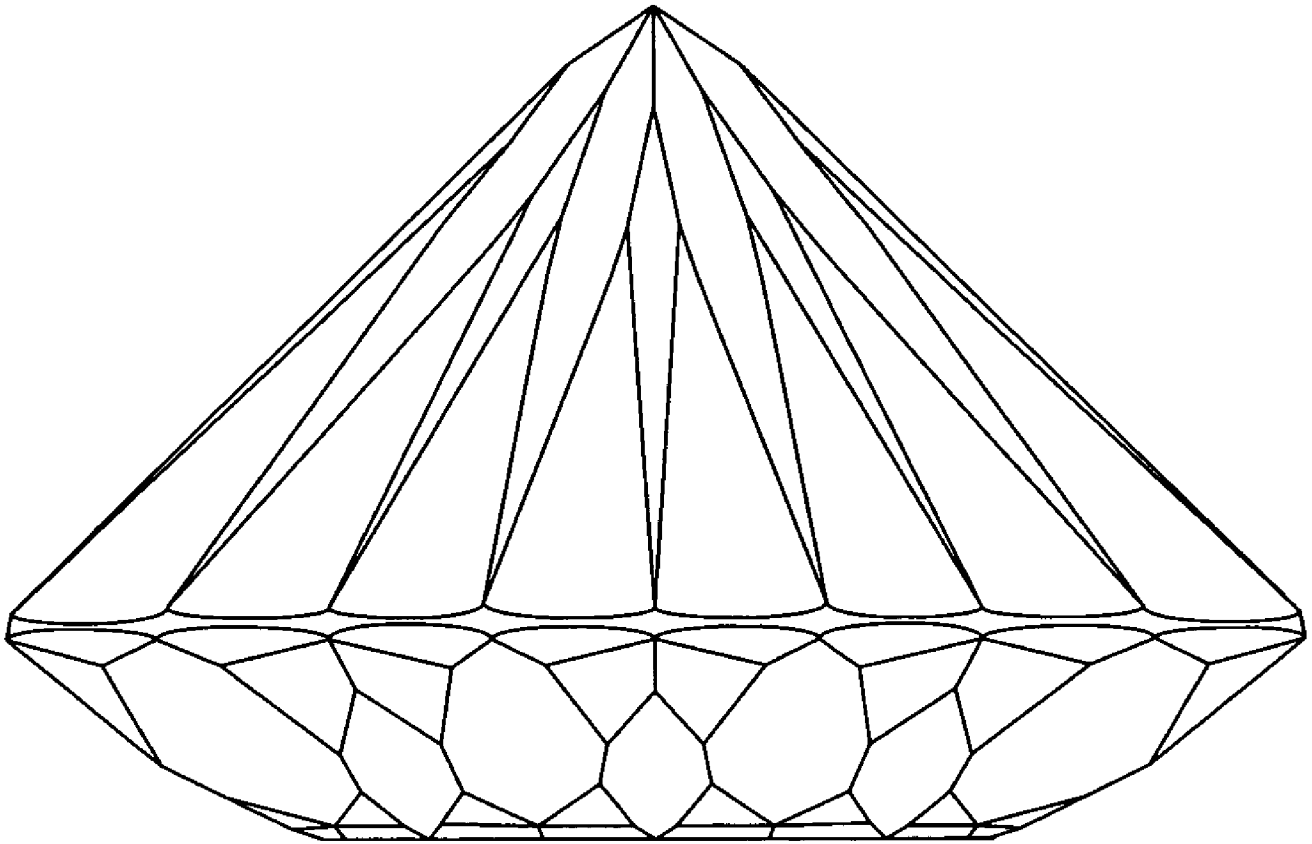
Figure 24B:
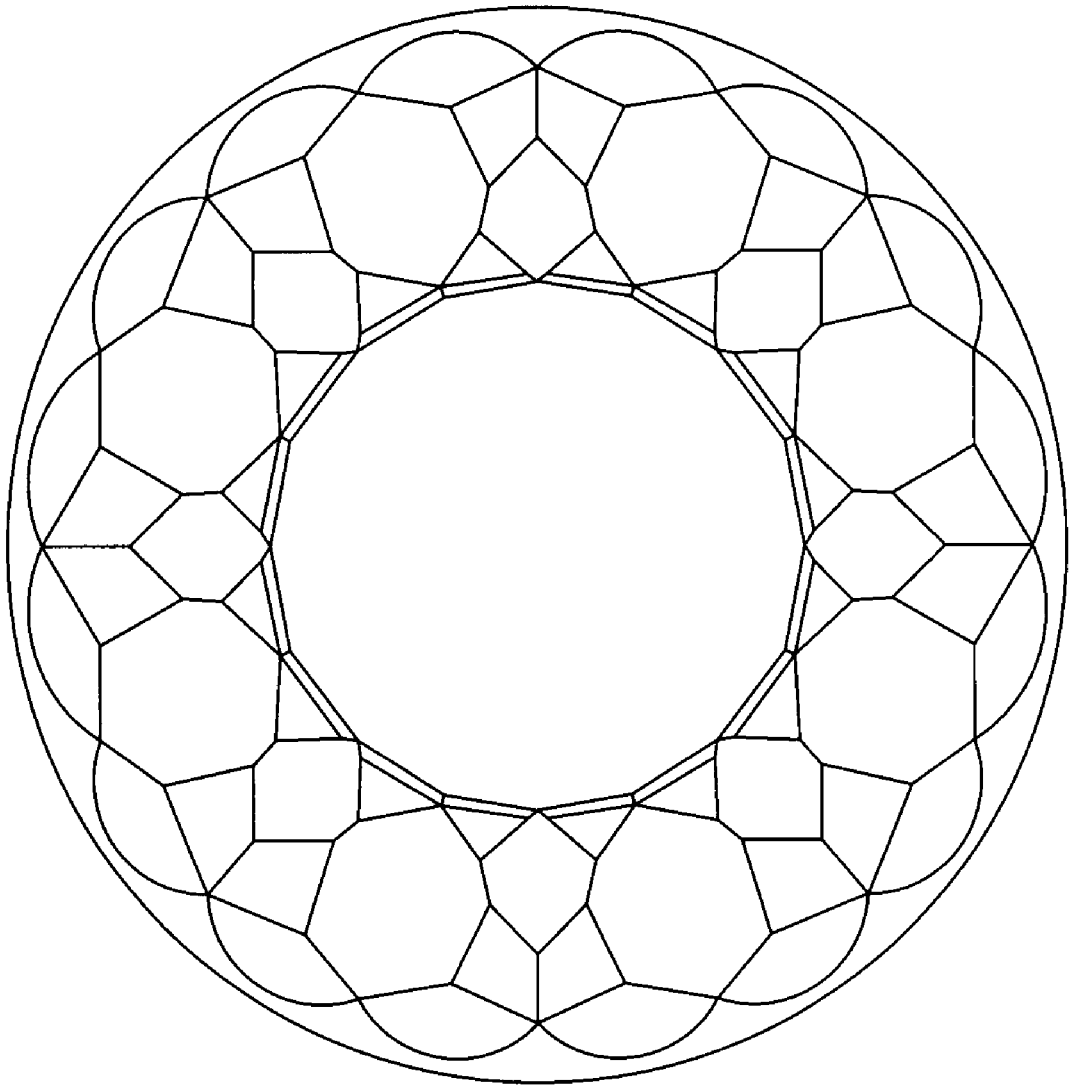
Figure 24C:
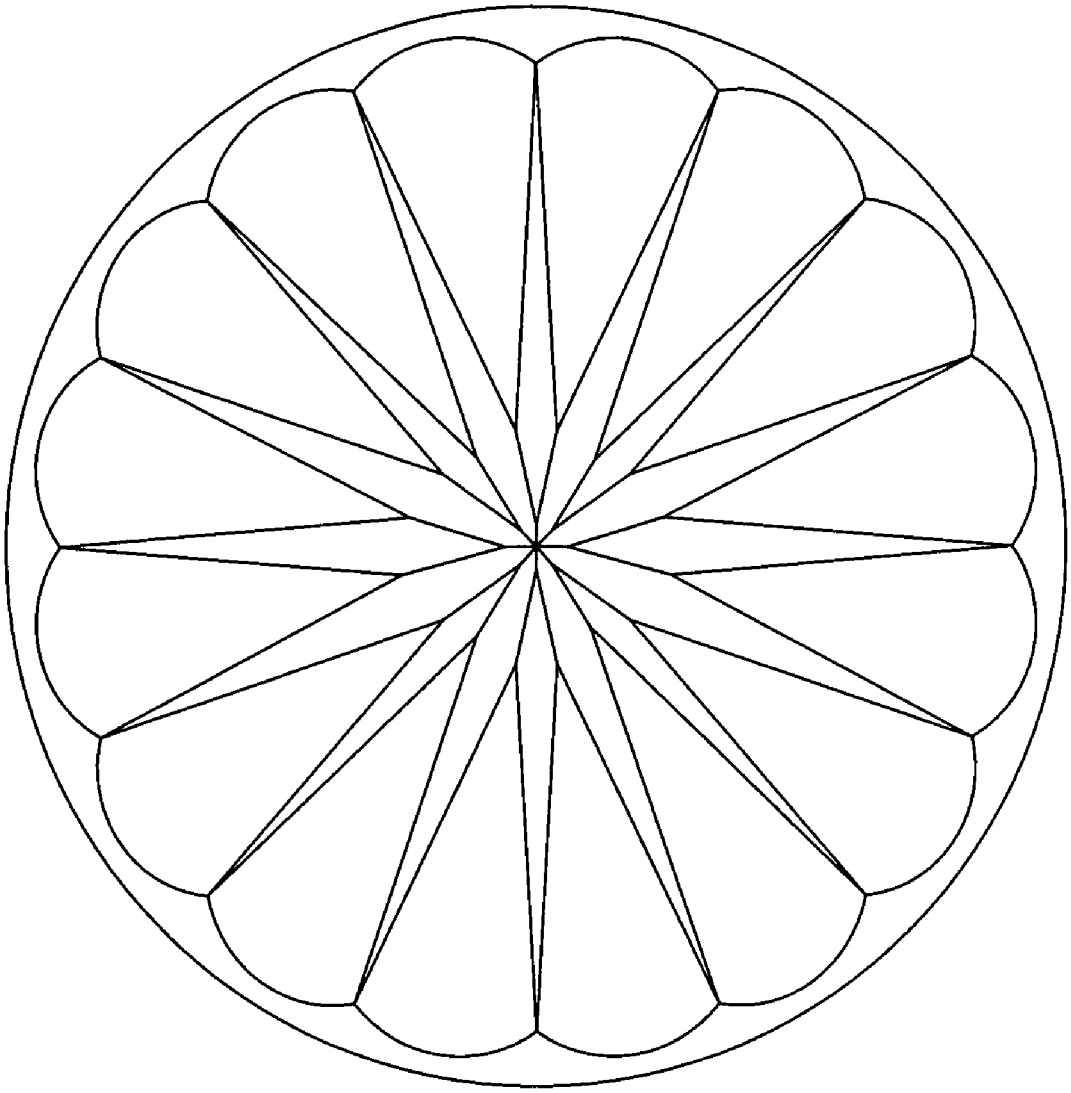

Referring to FIG. 20G the inception of the other secondary upper girdle facet 1314 is shown. It is cut identically to the first of FIGS. 19C and 19D above. Being that FIG. 20G is on right, this facet may be cut from higher and a bit right of primary upper girdle facet 1312 and the right point may reach center of bezel 1302 on right at the right end of the girdle facet 1304 and left point may reach vertical rib line at center of primary star facet 1308 between the two primary girdle facets 1312 at left end of girdle facet 1304. Referring to FIG. 20H, the finished secondary upper girdle facet 1314 of FIG. 20G is shown.

Figure 1:
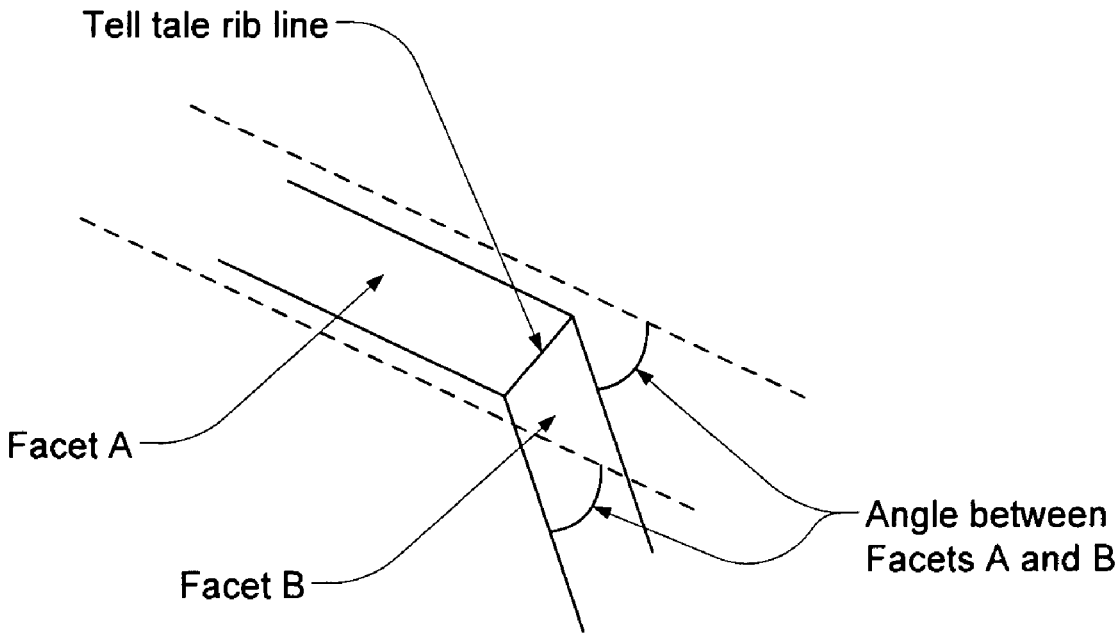
FIG. 1 shows a sketch of two facets providing a rib line.
Figure 2A:
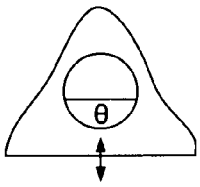
FIG. 2 shows the possible position of the line between the two facets.
Figure 2B:
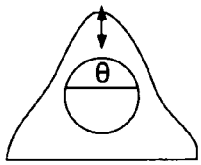
Figure 2C:
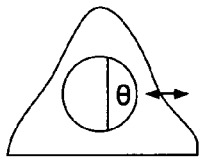
Figure 2D:
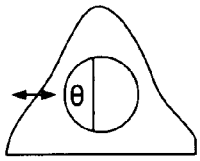
Figure 2E:
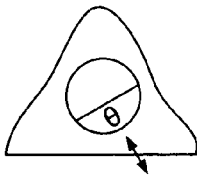
Figure 2F:
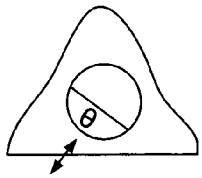
Figure 2G:
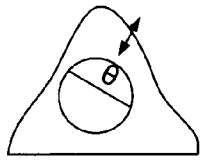
Figure 2H:
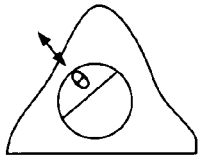
Figure 2I:
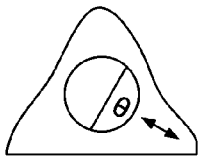
Figure 2J:
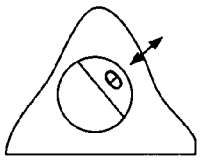
Figure 2K:
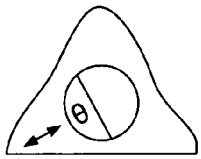
Figure 2L:
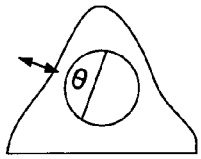
Figure 2M:
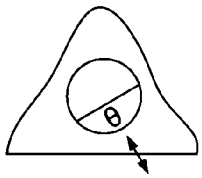
Figure 2N:
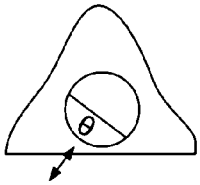
Figure 2O:
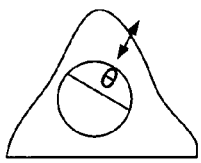
Figure 2P:
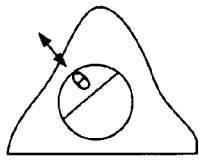
Figure 8:
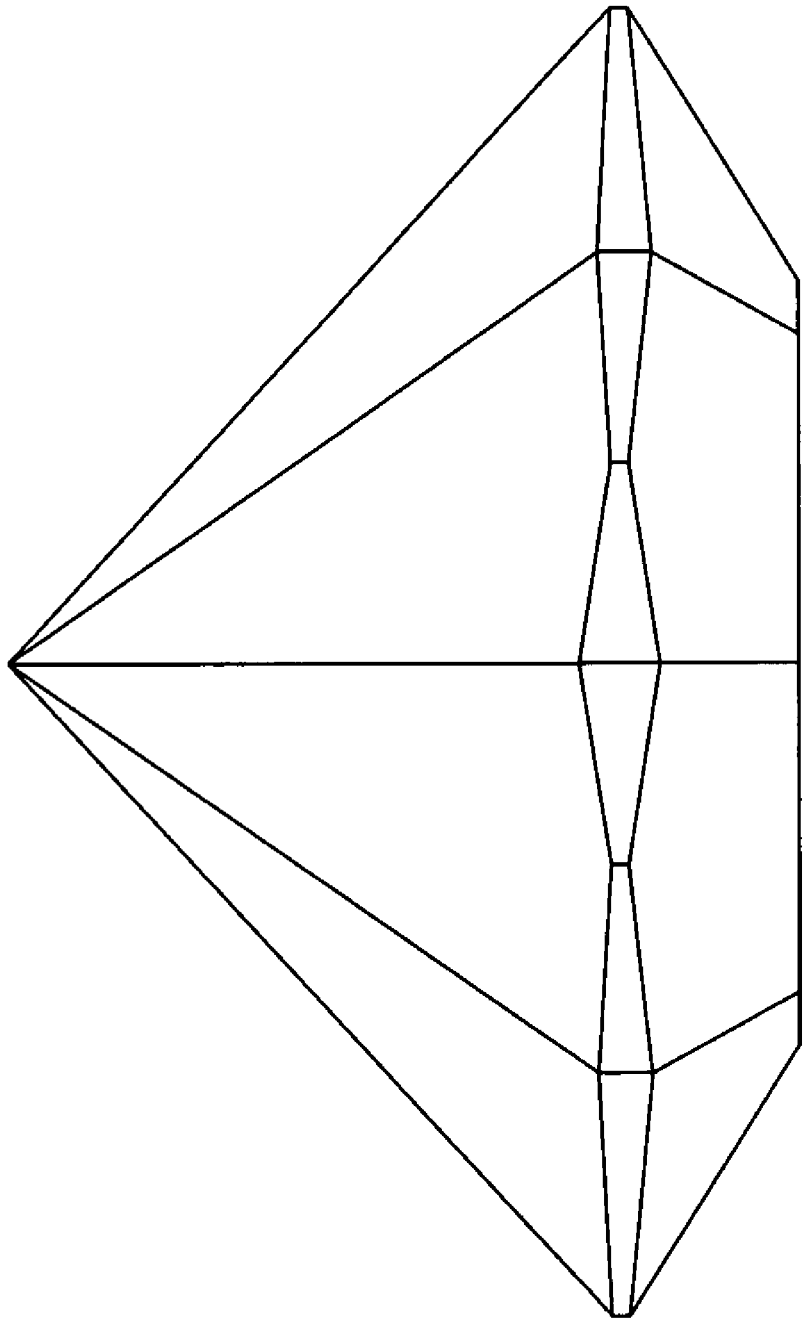
FIGS. 8-15 show a blocked to full cut stone used to cut the stone according to another exemplary embodiment.
Figure 9:
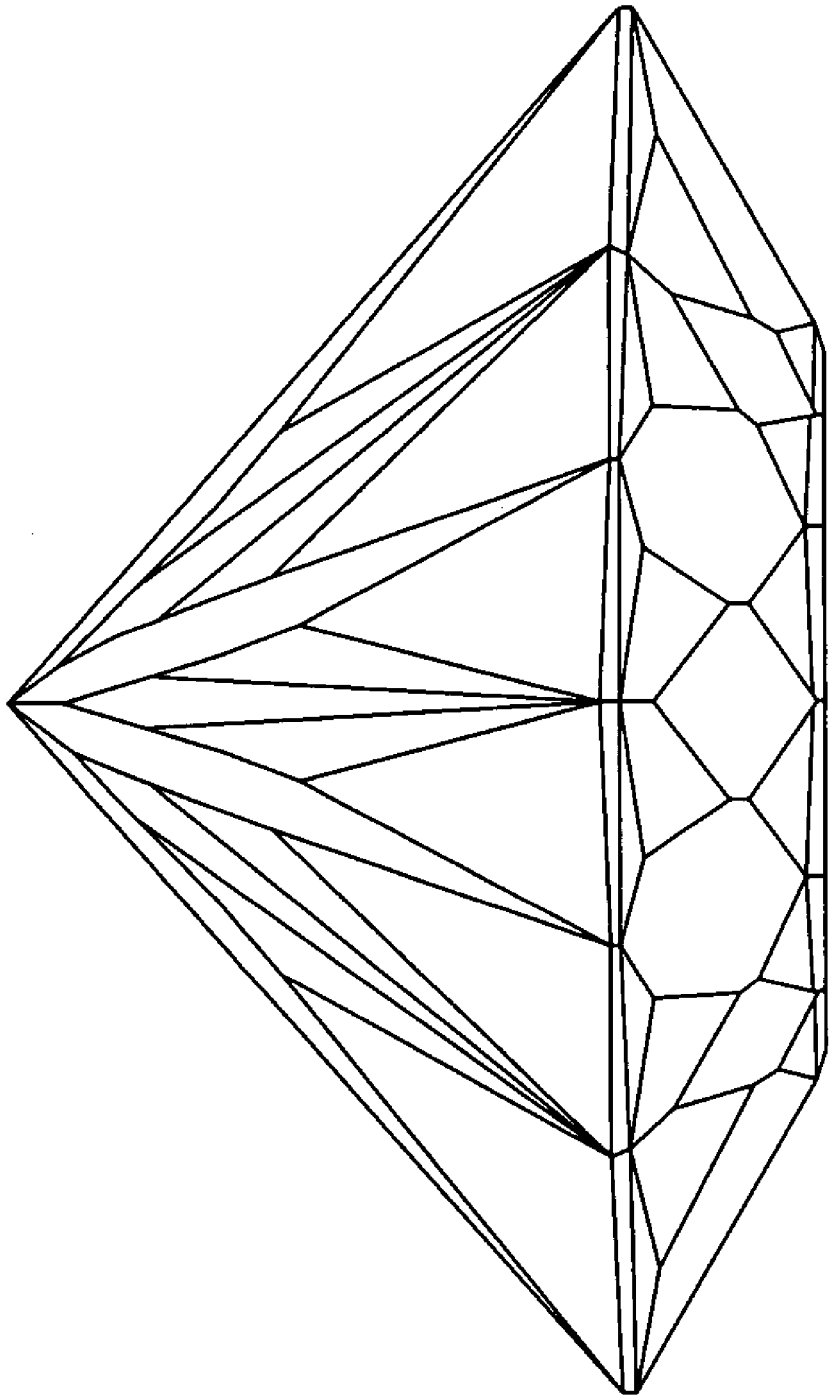
Figure 12:
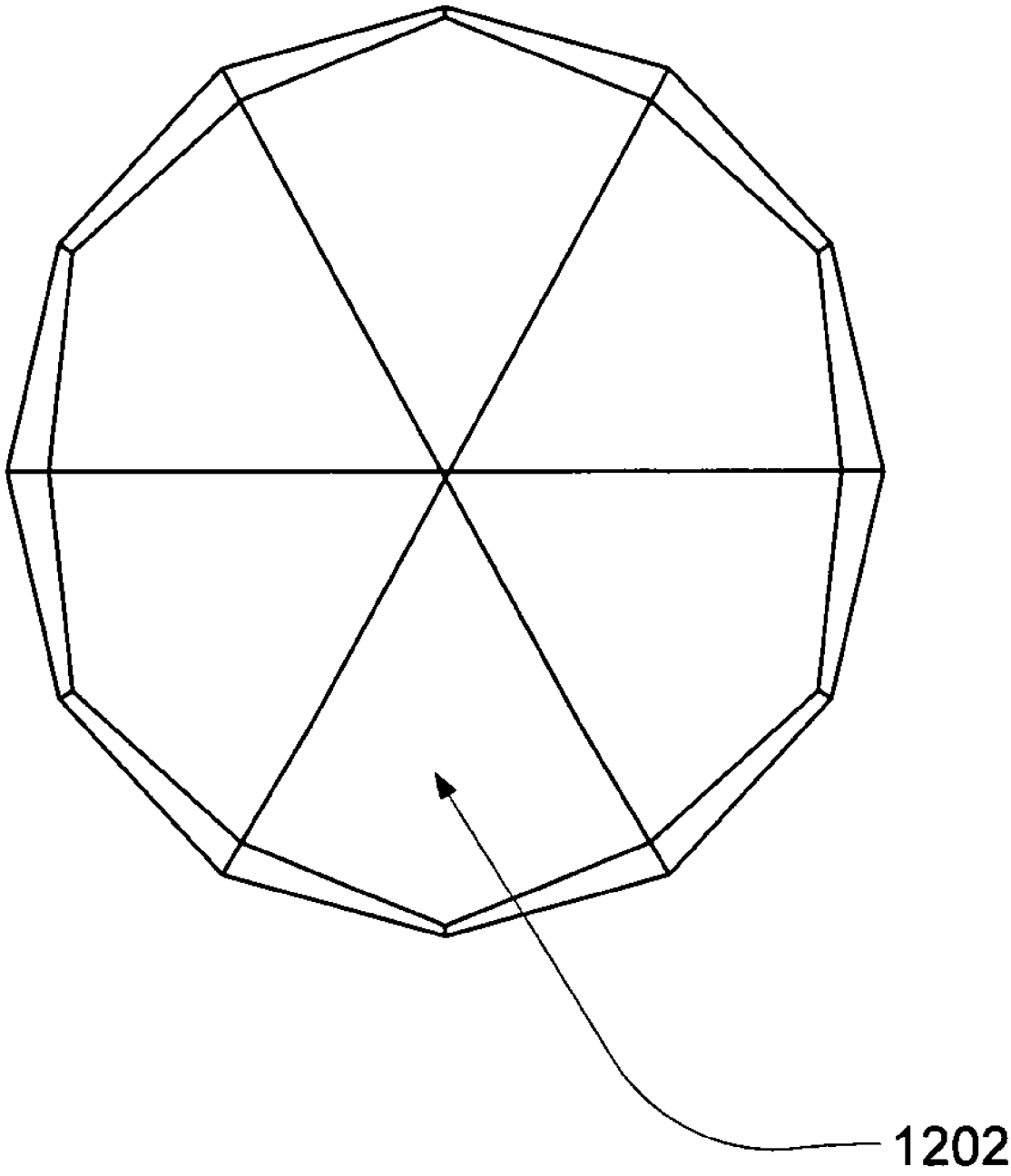
Figure 15:
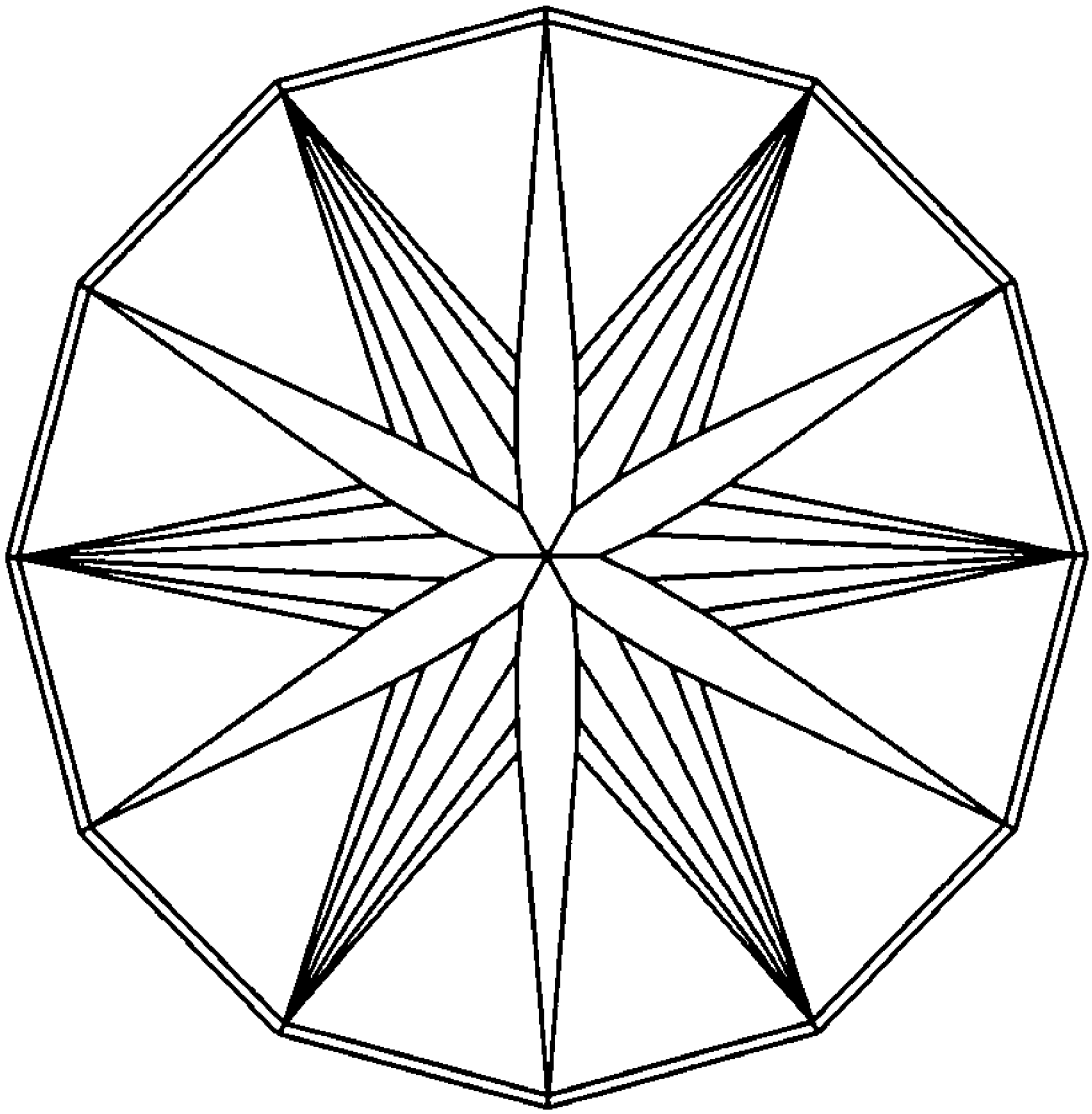

This style of girdle faceting and brilliandeering may be applied to any cut or shape when appropriate as one skilled in the art would appreciate. From 8 count (8 bezels and 8 pavilions) FIGS. 3A-3C each bezel and pavilion cut 45° away from its adjacent bezel and pavilion and 16 girdle facets each cut 22½° away from its adjacent girdle facet (see FIG. 1 to understand term "cut away"); the 16 girdle facets forming a very slightly modified circle, to 7 count (7 bezels and 7 pavilions) each bent away from its adjacent one 51.428° and 14 girdle facets (2 of each bezel and pavilion lined up underneath) each of the 14 cut 25.714° away from each other forming a slightly more modified circle; to 6 count FIG. 8, FIG. 10, and FIG. 12 each bezel and pavilion cut 60° away from each other and 12 girdle facets each cut 30° away from each other forming a slightly more modified circle; to 5 count resulting with each bezel and pavilion cut 72° away from each other and 10 girdle facets each cut 36° away from each other forming a slightly more modified circle; to 4 count resulting with each bezel and pavilion cut 90° away from each other and 8 girdle facets each cut 45° away from each other forming an octagon shape; to 3 count resulting with each bezel and pavilion cut 120° away from each other and 6 girdle facets each cut 60° away from each other forming a hexagon shape; these 6 exemplary blocking methods may be blocked with identical guide lines disclosed herein, i.e., bezels may be between 30° and 36° to girdle; pavilions directly underneath bezels may be between 40° and 42° to the girdle; bezels and pavilions may be cut equal amount of degrees away from each other; 2 girdle facets to each bezel and pavilion lined up underneath; and each girdle facet may be cut an equal amount of degrees away from each other. The only guide line that may change in the blocking of these 6 exemplary blocking methods is the table size. The ideal table size of the exemplary blocking method of 8 is 57% ranging from 59% to 55%; as the blocking count gets less, the table size may be smaller. In these 6 exemplary blocking methods the top may be brilliandeered with primary star facet as secondary bezel 1108. See FIG. 11, FIG. 13, and FIGS. 16A-20H. The bottom may be brilliandeered as discussed above regarding FIGS. 7A-7J. As blocking count becomes less, procedures of FIGS. 7E and 7I may be repeated more times (see FIG. 15) providing that previous secondary lower girdle facets are kept away from centers of pavilions. See the discussion above regarding FIGS. 7G and 7H. Being that these 6 exemplary blocking methods are perfectly symmetrical, i.e., all bezels and pavilions are identical in measurement and cut an equal amount of degrees away from each other, resulting in diamonds that are not long, the symmetry of the primary and secondary brilliandeering facets may be perfect, i.e., the primary star facets 1308 (or secondary bezels 1108) and primary lower girdle facets 430 may all be identical in measurements and these primary star facets 1308 may be cut directly between 2 bezels cutting equally into bezels on right and left. Likewise these primary lower girdle facets 430 may be cut directly between 2 pavilions cutting equally into pavilions on right and left. Likewise the pair of primary upper girdle facets 1312 may be identical in measurements, being that the bezels on right and left are same in length the primary upper girdle facets may also be the same in length and likewise the secondary upper girdle facets may be identical in measurements, i.e., the secondary upper girdle facets 1314 on right and left may be identical in length; and likewise the secondary star facets 1310 on right and left may be identical in length and likewise the secondary lower girdle facets 432 on right and left may be identical in width. In another embodiment of the 4 count resulting with each bezel and pavilion directly underneath cut 90° away from each other, the 8 girdle facets do not have to all be equally cut away from each other by 45° resulting in an octagon shape. This embodiment may have each of the 2 girdle facets on the 4 bezels and pavilions lined up underneath as a pair of girdle facets with each girdle facet of the pair cut 22½° away from each other and hence each pair of girdle facets would be cut 67½° away from the adjacent pair resulting in a modified square shape (a square shape in the diamond industry being a princess cut). Just by adding 4 very small girdle facets, one very small girdle facet on each point between the 4 pairs of girdle facets (the 4 sharp points of the modified square) may result in a cushion. Top is brilliandeered as shown in FIGS. 16A-20H and bottom as shown in FIGS. 7A-7J. In another embodiment of the 4 count resulting with each bezel and pavilion directly underneath cut 90° away from each other, 2 of the 4 bezels which are parallel to each other may be substantially longer that the $2^{nd}$ 2 bezels to which they are perpendicular, resulting in a rectangular shape. In this embodiment the symmetry can not be perfect. The 2 girdle facets on the longer bezels will be longer than the 2 girdle facets on the shorter bezels and hence the pair of girdle facets on the longer bezels will be cut away from each other slightly less degrees less than the pair of girdle facets on the shorter bezels in order for the pairs of girdle facets to line up with each other (to understand what is meant by the phrase "pairs of girdle facets to line up with each other" see FIG. 3A and/or FIG. 8 and note how girdle lines of girdle facets line up with each other, meaning they touch each other). Hence the pair of girdle facets on the shorter bezels may be cut 25° away from each other and the pair of girdle facets on the longer bezels may be cut 20° away from each other hence the 4 pairs of girdle facets may be cut 67½° away from each other forming a modified rectangular shape (a rectangular shape in the diamond industry being a radiant cut). Another reason why in this embodiment the symmetry can not be perfect is, being the bezels 90° and adjacent to each other are not of equal length the primary star facets 1308 (or secondary bezels 1108) and primary lower girdle facets 430 may all be identical in measurements, but may not be cut directly between bezels and directly between pavilions being that the bezel on the right of one primary star facet 1308 may be longer than the bezel on the left of this primary star facet 1308 and the primary star facet must approach the center of the bezel on the right; the same as it would approach the center of the bezel on the left; this primary star facet would not be cut directly between the 2 bezels cutting equally into the 2 bezels. This primary star facet would be cutting further, a greater distance, into the right bezel than into the left, being that the center of the bezel on right is further from starting point of primary star facet 1308 (indicated by arrow, see FIG. 16A) than the center of bezel on left, and being that from center of bezel on right is the greater distance back to the starting point of primary star facet 1308, and the secondary star facet 1310 on right must reach from center on right to that point (see FIGS. 16A-16J) then the secondary star facet 1310 on right. Likewise being that the pavilion on the right of one primary lower girdle facet 430 may be wider than the pavilion on the left of this primary lower girdle facet 430 and the primary lower girdle facet 430 must approach the center of the pavilion on the right; the same as it would approach the center of the pavilion on the left; this primary lower girdle facet 430 would not be cut directly between the 2 pavilions cutting equally into the 2 pavilions. This primary lower girdle facet 430 would be cutting further, a greater distance, into the right pavilion than into the left, being that the center of the pavilion on right is further from starting point of primary lower girdle facet 430 (indicated by arrow see FIG. 7A), than center of pavilion on left, and bring that from center of pavilion on right is the greater distance back to the starting point of primary lower girdle facet 430, and the secondary lower girdle facets 432 on right must reach from center on right to that point, See FIGS. 7A-7J. The secondary lower girdle facets (or facet) 432 on right will automatically be wider than the secondary lower girdle facet 432 on left. Concerning the pair of primary upper girdle facets 1312 underneath the aforementioned primary star facet 1308 and secondary star facets 1310, the primary upper girdle facet 1312 on right of pair would simply be longer than the primary upper girdle facet 1312 on left. See FIGS. 19A-19D, where the secondary upper girdle facet 1314 on right would be longer than the secondary upper girdle facet 1314 on left. See FIGS. 20E-20H. In another embodiment of 4 counts all bezels and pavilions may be identical in measurements but not 90° to each other. In this embodiment there may be 2 obtuse angles opposite each other and 2 acute angles opposite each other; accordingly where the pairs of girdle facets meet by the 2 acute angles there will be very acute angles between the 2 girdle facets. By all the other 6 places where girdle facets meet they may be equally slightly cut away from each other forming a marquise shape. The primary star facets 1308 opposite each other where the bezels form obtuse angles may be much longer than the primary star facets 1308 where the bezels form acute angles the rest of the brilliandeering on top may set in following the FIGS. of 16C-20H and the guidelines discussed above. In summary, secondary brilliandeering is setting in facets by connecting points from one end of the girdle facet on left to the other end of that same girdle facet on the right of the secondary brilliandeering's starting point which is always on the point of a rib line of its primary brilliandeering facet. See FIGS. 16B-18J and FIGS. 20E-20H. For primary upper girdle faceting see FIGS. 19A-19D, and for bottom brilliandeering see FIGS. 7A-7J. Another embodiment may be a pear shape in which half of the diamond would be blocked and girdle faceted as half of the exemplary round stone of 8 count cut from a round stone, consisting of 4 bezels and 4 pavilions underneath with 8 girdle facets cut into a semicircle and the other half blocked and girdle faceted as half of the marquise discussed just above with 2 long bezels and 2 wide pavilions and two pair of girdle facets form the point of the pear shape where 2 girdle facets meet at an acute angle. The primary and secondary brilliandeering on the top may be cut as shown in FIGS. 16A-20H and the guidelines discussed above. The bottoms of both the marquise and pear shape may be brilliandeered as discussed in directions to lower girdle sets, and guidelines discussed above. In another embodiment the 3 count may be blocked into an isosceles triangle with 3 bezel and 3 pavilions directly underneath cut 120° away from each other forming 60° angles to each other but instead of all 6 girdle facets cut 60° away equally from each other to form a perfect hexagon the pairs of girdle facets may be cut 90° from each other and the 2 girdle facets of each pair of girdle facets cut 30° away from each other forming a modified triangle (triangle shaped diamonds are known as trilliants). This embodiment may be brilliandeered as shown in FIGS. 16A-20H for top and FIGS. 7A-7J for bottom. By cutting a groove in the middle of one of the sides of the triangle and rounding off the 2 points on right and left of that groove leaving the point opposite the groove sharp, a heart shape may be formed. The 8-5 count cuts may be elongated to form the oval shapes as shown in FIGS. 21A-21C, FIGS. 22A-22C, and FIGS. 24A-24C. Primary and secondary brilliandeering may be practiced on a perfectly round stone.

The exemplary methods disclosed herein may be implemented in a variety of manners as previously discussed. The embodiment and various aspects of the invention may be implemented using a variety of stones and is not limited to diamond. Persons skilled in the art will appreciate that the present invention can be practiced by other than the described examples and embodiments, which are presented for purposes of illustration rather than of limitation and that the present invention is limited only by the claims that follow.

What is claimed is:

1. A gemstone which comprises:

a crown comprising:

a table surrounded by six bezel facets;

six star sets; and six pairs of upper girdle facet sets, wherein each star set includes one primary star facet and at least two secondary star facets, wherein each pair of the upper girdle facet sets includes two primary upper girdle facets and at least two secondary upper girdle facets, wherein each bezel facet is nonadjacent from every other bezel facet, wherein the primary star facets are polygons having 4, 6, or 8 sides, wherein each primary star facet is positioned between two bezel facets and each primary star facet is cut approximately 3 or 4 degrees flatter than the adjacent bezel facets, wherein each primary upper girdle facet is a quadrilateral polygon, wherein each primary star facet extends at least 70% from the table toward the girdle, and wherein when the gemstone is viewed from above, it appears to have a scalloped perimeter, and a bottom comprising:

six lower girdle facet sets and six main facets, wherein each lower girdle facet set includes one primary lower girdle facet and at least four secondary lower girdle facets.

2. A gemstone of claim 1, wherein one of the secondary upper girdle facets for each upper girdle facet set is a narrow rectangular facet adjacent, parallel, and lined up to a girdle facet of the gemstone.

3. A gemstone of claim 1, wherein two of the secondary star facets for each star set are each a narrow rectangular facet adjacent to the table.

4. A gemstone of claim 1, wherein each upper girdle set has one of the secondary upper girdle facets as a first narrow rectangular facet adjacent, parallel, and lined up to a girdle facet of the gemstone and further comprises a third secondary upper girdle facet as a second narrow rectangular facet adjacent, parallel, and lined up to the first narrow rectangular facet.

5. A gemstone of claim 1, wherein each star set has two of the secondary star facets as two first upper narrow rectangular facets adjacent to the table and further comprises each star set having two additional secondary star facets as second narrow rectangular facets adjacent to the first narrow rectangular facets.

6. A gemstone of claim 1, wherein a bottom has a total of forty lower girdle facets.

7. A gemstone of claim 1, wherein the pair of primary upper girdle facets intersect the primary star facet.

8. A gemstone of claim 1, wherein girdle facets are adjacent, parallel, and lined up with the upper and lower secondary girdle facets forming a modified round gemstone.

9. A gemstone comprising a crown which comprises:

a table surrounded by six bezel facets;

six star sets; and six pairs of upper girdle facet sets, wherein each star set includes one primary star facet and at least two secondary star facets, wherein each pair of the upper girdle facet sets includes two primary upper girdle facets and at least two secondary upper girdle facets, wherein each bezel facet is nonadjacent from every other bezel facet, wherein the primary star facets are polygons having 4, 6, or 8 sides, wherein each primary star facet is positioned between two bezel facets and each primary star facet is cut approximately 3 or 4 degrees flatter than the adjacent bezel facets, wherein each primary upper girdle facet is a quadrilateral polygon, wherein each primary star facet extends at least 70% from the table toward the girdle, and wherein when the gemstone is viewed from above, it appears to have a scalloped perimeter.

10. A gemstone of claim 9, wherein the primary star facets are quadrilateral polygons.

* * * * *